US008876421B2

(12) United States Patent
Suda

(10) Patent No.: US 8,876,421 B2
(45) Date of Patent: Nov. 4, 2014

(54) CLEANING TOOL

(75) Inventor: Tomokazu Suda, Kagawa-ken (JP)

(73) Assignee: Uni-Charm Corporation, Ehime (JP)

( * ) Notice: Subject to any disclaimer, the term of this patent is extended or adjusted under 35 U.S.C. 154(b) by 1096 days.

(21) Appl. No.: 12/096,477

(22) PCT Filed: Dec. 7, 2006

(86) PCT No.: PCT/JP2006/324488

§ 371 (c)(1),
(2), (4) Date: Sep. 16, 2009

(87) PCT Pub. No.: WO2007/066739

PCT Pub. Date: Jun. 14, 2007

(65) Prior Publication Data

US 2010/0028072 A1 Feb. 4, 2010

(30) Foreign Application Priority Data

Dec. 9, 2005 (JP) ..... 2005-356867

(51) Int. Cl.

| | |
|---|---|
| ***A46B 11/00*** | (2006.01) |
| ***A47L 13/26*** | (2006.01) |
| ***A47L 13/46*** | (2006.01) |
| ***A47L 13/20*** | (2006.01) |
| ***A47L 13/22*** | (2006.01) |
| ***A47L 13/42*** | (2006.01) |

(52) U.S. Cl.

CPC ..... *A47L 13/26* (2013.01); *A47L 13/46* (2013.01); *A47L 13/20* (2013.01); *A47L 13/22* (2013.01); *A47L 13/42* (2013.01)

USPC ..... 401/140; 401/139

(58) Field of Classification Search

USPC ..... 401/139, 140, 251; 24/593.1, 598.5, 24/594.1; 403/375

See application file for complete search history.

(56) References Cited

U.S. PATENT DOCUMENTS

| | | | | |
|---|---|---|---|---|
| 2,990,979 | A * | 7/1961 | Harrison et al. | 222/482 |
| 4,013,369 | A * | 3/1977 | Turek | 401/139 |
| 4,954,001 | A | 9/1990 | Billat | |
| 6,698,700 | B2 * | 3/2004 | Moerke et al. | 248/220.31 |

(Continued)

FOREIGN PATENT DOCUMENTS

| | | |
|---|---|---|
| EP | 1 602 311 A2 | 12/2005 |
| JP | 2004242799 | 9/2004 |

(Continued)

OTHER PUBLICATIONS

English translation of First Office Action from corresponding Chinese application No. 2006800459482 dated Jan. 8, 2010, 19 pages.

(Continued)

*Primary Examiner* — David Walczak
*Assistant Examiner* — Bradley Oliver
(74) *Attorney, Agent, or Firm* — Brinks Gilson & Lione

(57) ABSTRACT

With respect to a cleaning tool having a sheetlike cleaning member for mopping a surface to be cleaned, it is intended to provide a technology effective for enhancing of cleaning effect. There is provided cleaning tool (10) comprising cleaning sheet (100) for mopping a surface to be cleaned and injection nozzle (252) for jetting a cleaning liquid toward the surface to be cleaned at its region under the cleaning sheet (100).

18 Claims, 12 Drawing Sheets

(56) References Cited

U.S. PATENT DOCUMENTS

| | | | | |
|---|---|---|---|---|
| 6,742,951 | B2 * | 6/2004 | Schultz et al. | 401/139 |
| 2004/0018038 | A1 | 1/2004 | Schultz et al. | |
| 2006/0171767 | A1 * | 8/2006 | Hoadley et al. | 401/136 |
| 2006/0171768 | A1 | 8/2006 | Hoadley et al. | |

FOREIGN PATENT DOCUMENTS

| | | | |
|---|---|---|---|
| JP | 2004242799 | A | 9/2004 |
| JP | 2004305473 | | 11/2004 |
| JP | 2004305473 | A | 11/2004 |
| JP | 2005-533567 | A | 11/2005 |
| JP | 2005533567 | | 11/2005 |
| WO | WO 2004/008931 | A1 | 1/2004 |
| WO | WO 2006/113386 | A2 | 10/2006 |

OTHER PUBLICATIONS

English translation of Office Action from corresponding Japanese application No. 2005-356867 dated Aug. 23, 2010, 21 pages.
European Search Report from corresponding European application No. 06834243.5 dated Jan. 14, 2014 (3 pgs).

* cited by examiner

CLEANING TOOL

CROSS-REFERENCE TO PRIOR APPLICATION

This is a U.S. National Phase Application under 35 U.S.C. §371 of International Patent Application No. PCT/JP2006/324488 filed Dec. 7, 2006, and claims the benefit of Japanese Patent Application No. 2005-356867, filed Dec. 9, 2005, both of them are incorporated by reference herein. The International Application was published in Japanese on Jun. 14, 2007 as WO 2007/066739 A1 under PCT Article 21(2).

FIELD OF THE INVENTION

The present invention relates to a cleaning tool, and more particularly to a cleaning tool having a sheet-type cleaning element for wiping a region to be cleaned inside a room or a vehicle and so on.

BACKGROUND OF THE INVENTION

Various types of cleaning tools having a sheet-type cleaning element for wiping a region to be cleaned are known. For example, Japanese non-examined laid-open Patent Publication No. 2004-242799 discloses a cleaning tool in which an agent permeating bottom part is provided on the bottom of a cleaning frame and the cleaning sheet is wrapped around the agent permeating bottom part. In this known cleaning tool, in use for wiping, the cleaning sheet is dampened with a cleaning agent which is sprayed from above the agent permeating bottom part during cleaning operation. Such a cleaning tool is capable of wiping off tough dirt on a floor surface which is difficult to remove with a dry cleaning sheet. However, in designing a cleaning tool of this type having a sheet-type cleaning element, a technique for further enhancing the cleaning effect is desired.

DISCLOSURE OF THE INVENTION

Problems to be Solved by the Invention

It is, accordingly, an object of the present invention to provide an effective technique for enhancing the cleaning effect in a cleaning tool having a sheet-type cleaning element for wiping a face to be cleaned.

Means for Solving the Problems

The above-described problem can be solved by the features of the claimed invention. This invention can be applied to the construction of cleaning tools having a sheet-type cleaning element for wiping faces to be cleaned (floors, walls, ceilings, external walls, furniture, clothes, curtains, bedding, home electric appliances, etc.) inside and outside of houses, apartments, buildings, factories, vehicles, etc. or faces of human body parts to be cleaned.

The above-described problem can be solved with the cleaning tool according to this invention. The cleaning tool includes at least a cleaning element, a holding part, a grip, a connecting part and a cleaning liquid supply part.

The cleaning element of this invention is designed as a sheet-type cleaning element for wiping a face to be cleaned. The "sheet-type cleaning element" here widely includes those having a plate-like form in the state in which it is attached to or detached from the holding part, which plate-like form is considerably longer and wider than is thick. The surface of the cleaning element may be either flat or curved, uneven or stepped. The cleaning element may be of disposable type designed for single use, or reusable type which can be reused by washing. The cleaning element is typically formed of plastic nonwoven fabric or a laminate thereof, or resin foam. The faces to be cleaned may be either flat or curved, uneven or stepped.

The holding part in this invention is configured to be attached to the cleaning element and designed to detachably hold the cleaning sheet. Thus, the cleaning element can be removed from the holding part and replaced with new one as necessary depending on the degree of dirt of the cleaning element.

The grip in this invention is configured as an elongate part to be held by a user. The user can hold the grip and perform a wiping operation by the cleaning element. Further, preferably, the cleaning element may have a rectangular shape, and the long side of the rectangular cleaning element is designed to extend along the length direction of the elongate grip. With this construction, the efficiency of user's wiping operation can be easily improved.

The connecting part in this invention is disposed between the holding part and the grip and designed to fixedly connect the holding part and the grip. Specifically, the holding part and the connecting part are fixedly connected together, and the grip and the connecting part are fixedly connected together. Thus, as a whole, the holding part, the connecting part and the grip are integrally fixed to each other. In this case, two or all of the holding part, the connecting part and the grip may be integrally molded, or all of them may be separately molded and thereafter fixedly connected together. The structure of "fixedly" connecting the holding part and the grip in this invention only requires that the holding part and the grip are integrally fixed or retained at least during use of the cleaning tool. Therefore, it includes not only a structure in which relative movement at the connection between the holding part and the connecting part or at the connection between the grip and the connecting part is disabled, but also widely includes a movable structure in which relative movement at these connections is temporarily enabled. With regard to this movable structure, specifically, a hinge mechanism and a locking mechanism can be provided at the connection between the holding part and the connecting part or at the connection between the grip and the connecting part. The angle between the holding part and the connecting part or the angle between the grip and the connecting part can be adjusted via the hinge mechanism before and after use of the cleaning tool, and it can be locked or retained at a predetermined angle by the locking mechanism during use of the cleaning tool.

The cleaning liquid supply part in this invention has a supply nozzle for supplying cleaning liquid toward the face to be cleaned, and is disposed on at least one of the holding part, the grip and the connecting part. The "cleaning liquid" here widely includes liquids which can be used for cleaning operation of removing dirt. Typically, a cleaner for cleaning floor, a polishing wax-containing cleaner, a fragrance-containing cleaning liquid, a deodorant-containing cleaning liquid, or dilution of any of those liquids with water, or water itself can be used as the cleaning liquid. Further, as the manner of "supplying cleaning liquid", a supply manner of injecting or jetting cleaning liquid or spraying it in an atomized state, or a supply manner of dropping cleaning liquid can be used, provided that the cleaning liquid is supplied not via the cleaning element but directly onto the face to be cleaned. Further, in this invention, the cleaning liquid supply part may be mounted on any one of the holding part, the grip and the connecting part, or it may be mounted to extend on more than one of the holding part, the grip and the connecting part. Once the face to be cleaned onto which the cleaning liquid has been supplied is wiped with the cleaning element, the cleaning element can be used as a wet-type cleaning element with a damp sheet surface. In a cleaning operation using the cleaning element without supplying the cleaning liquid on the face to be cleaned, naturally, the cleaning element can also be used as a dry-type cleaning element with a normally dry sheet surface.

Further, as for the specific construction of the cleaning liquid supply part, for example, the construction which uses a pump mechanism to pressurize cleaning liquid and discharge the pressurized cleaning liquid to the supply nozzle, the construction of aerosol type which supplies pressurized cleaning liquid to the supply nozzle by using gas pressure, the construction which causes cleaning liquid to drop from the supply nozzle under its own weight, and the construction which supplies cleaning liquid to the supply nozzle after the cleaning liquid is pressurized in a cleaning liquid supply source outside the cleaning liquid supply part, can be appropriately used. Further, the cleaning liquid supply part may be configured to include a region which stores cleaning liquid and a path through which the cleaning liquid flows, or to include only a region through which cleaning liquid flows after the cleaning liquid is supplied from the cleaning liquid supply source located outside the cleaning liquid supply part.

Further, in this invention, an extension line in a length direction of the grip intersects with a normal to a sheet plane of the cleaning element at a predetermined angle. With this construction and with the construction in which the holding part, the connecting part and the grip are integrally fixed to each other, the cleaning tool of this invention is designed specifically as a hand-held cleaning tool of which length from the grip to the holding part via the connecting part is limited within a predetermined range so that a user can hold and use the cleaning tool with one hand for cleaning operation.

With this construction, dirt and dust which are stuck to the face and difficult to wipe off with a dry-type cleaning element can be easily wiped off by supplying cleaning liquid from the supply nozzle of the cleaning liquid supply part onto the face to be cleaned and then wiping this cleaning liquid supplied area with the cleaning element. Particularly, in this invention, the cleaning liquid is supplied directly onto the face to be cleaned, so that the cleaning effect of the cleaning liquid itself can be maximized. Therefore, compared with a cleaning tool in which cleaning liquid is supplied not onto the face to be cleaned but to the cleaning element, this construction is advantageous and effective in improving the cleaning effect.

In the above-described cleaning tool, preferably, the supply nozzle of the cleaning liquid supply part may be located below the grip and rearward of the connecting part.

With this construction, supply of the cleaning liquid from the supply nozzle to the face to be cleaned is not easily interfered with by the long grip and the connecting part. Further, the user can readily check the cleaning liquid supplied area from behind, so that the operation of supplying the cleaning liquid can be smoothly and reliably performed.

In the above-described cleaning tool, preferably, a region of connection between the holding part and the connecting part may generally coincide with a rear end of the cleaning element. In other words, the supply nozzle may be located rearward of the connecting part and preferably rearward of the rear end of the cleaning element.

With this construction, supply of the cleaning liquid from the supply nozzle to the face to be cleaned is not easily interfered with by the cleaning element.

Preferably, further in terms of the direction of installation height, the supply nozzle of this cleaning tool may be located above a sheet lower surface of the cleaning element and in a height region in which an extension line of the holding part intersects with an extension line of the connecting part. In other words, preferably, the supply nozzle may be located below the grip and rearward of the connecting part, and above a sheet lower surface of the cleaning element and in a height region in which an extension line of the holding part intersects with an extension line of the connecting part.

With this construction, when the cleaning element is in contact with the face to be cleaned, the supply nozzle can be prevented from interfering with the face to be cleaned. Further, the supply nozzle can be located as close as possible to the face to be cleaned, so that the cleaning liquid can be reliably and promptly supplied onto a desired region on the face to be cleaned.

Preferably, the cleaning liquid supply part of this cleaning tool may be configured to supply the cleaning liquid from the supply nozzle obliquely downward and forward toward a region located below the cleaning element.

With this construction, subsequently to supply of the cleaning liquid from the supply nozzle, in the as-is state, the cleaning element can be moved downward and used for a wiping operation. Thus, a series of operations from a cleaning liquid supply operation to a subsequent wiping operation with the cleaning element can be more smoothly performed.

In the cleaning tool, preferably, the orientation of the supply nozzle of the cleaning liquid supply part may conform to an extending direction of the connecting part. The extending direction of the connecting part represents the direction in which the connecting part extends from the grip to the holding part, and if the connecting part is curved, a tangent to the curve of the connecting part at a predetermined point can be defined as the extending direction of the connecting part.

With the construction in which the orientation of the supply nozzle conforms to the extending direction of the connecting part, the operation of supplying a cleaning liquid to the face to be cleaned and the operation of wiping with the cleaning sheet can be facilitated.

In the cleaning tool, preferably, the cleaning liquid supply part may include a pump mechanism that pressurizes cleaning liquid by user's manual operation of an operation part and then discharges the pressurized cleaning liquid to the supply nozzle. As the pump mechanism, a mechanical pump mechanism which is actuated by using a pressing force applied in the user's manual operation of the operation part, or an electric pump mechanism which is actuated by a driving force of an electric motor, which electric motor is driven in conjunction with the user's manual operation of the operation part, can be appropriately used. Further, the manual operation of the operation part includes the operation of pressing or depressing the operation part in the form of a push button, and the operation of sliding the operation part in the form of a slide switch.

With the construction, the pump mechanism can be used as a means for supplying cleaning liquid to the supply nozzle.

In the cleaning tool, preferably, the operation part may be disposed on the underside of the grip, and the pump mechanism is actuated by user's operation of depressing the operation part with a finger while holding the grip with the hand. By using the depressing operation with the user's finger to actuate the pump mechanism, the application of force to the operation part can be easily achieved. Further, the action of holding the grip is an extension of the depressing operation with the finger. Therefore, the user can hold the grip and smoothly perform the depressing operation with the finger.

Further, this construction is preferably configured such that the operation part is located in the position of the ball of the user's forefinger when the grip is held by the user.

With this construction, actuation of the pump mechanism can be effected by the user's operation of depressing the operation part with the finger.

Preferably, the operation part in the cleaning tool may be configured as an operation button to be touched by the user's finger, and a finger entry preventing region for preventing entry of the user's finger is provided between the operation button and the grip. The "finger entry preventing region" here is defined as a region which is configured such that an unnecessary hollow or space into which the user's hand or finger may be caught in or enter and thus interfere with user's operation is not created between the operation button and the grip. This provision of the finger entry preventing region is typically realized by the construction configured such that a base of the operation button which is located on the grip side is as large as or slightly larger than a top of the operation button and such that the outer edge portion of the base of the operation button extends substantially straight toward the outer edge portion of the top of the operation button. Particularly, in the case of a hand-held cleaning tool, the position of the hand or finger of the user holding the grip and the grip force applied to the hand or finger vary depending on the kind of the face to be cleaned or other similar factors. Therefore, with a construction having an unnecessary space between the operation button and the grip, the user's hand or finger may be caught on the operation button or enter the space, which may interfere with the user's operation. It is therefore preferred to provide the finger entry preventing region between the operation button and the grip.

This construction can prevent occurrence of such a trouble that may interfere with the operation.

Preferably, the pump mechanism in the cleaning tool may discharge a predetermined amount of cleaning liquid to the supply nozzle in one manual operation of the operation part.

With this construction, the user can supply a predetermined amount of cleaning liquid from the supply nozzle to the face to be cleaned in one manual operation of the operation part. Preferably, the amount of discharge of the cleaning liquid in one manual operation of the operation part is set to the minimum so that the amount of supply of the cleaning liquid to the face to be cleaned can be adjusted in fine increments. With this construction, excessive supply of the cleaning liquid to the face to be cleaned can be prevented by repeating the manual operation until a desired amount of cleaning liquid is supplied to the face to be cleaned.

Preferably, the cleaning liquid supply part in the cleaning tool may further include an adjusting mechanism. Particularly preferably, the adjusting mechanism may have a function of adjusting the conditions for supplying the cleaning liquid from the supply nozzle to the face to be cleaned. The "conditions for supplying the cleaning liquid" include the amount, the range (angle), the distance and the area of supply of the cleaning liquid. For example, in a construction in which the cleaning liquid is injected (jetted) from the supply nozzle, it represents the amount, the range (angle), the distance and the area of injection (jet) of the cleaning liquid. As for the specific construction of the adjusting mechanism, it may be constructed such that the sectional area of the throttle hole within the supply nozzle can be adjusted by using a switch or other similar switching device, so that the conditions for supplying the cleaning liquid can be adjusted.

With provision of the adjusting mechanism, the conditions for supplying the cleaning liquid can be adjusted depending on the degree of dirt of the face to be cleaned. Thus, the cleaning tool having higher usability can be provided.

The cleaning liquid supply part in the cleaning tool may preferably include a housing that forms an outer shell of the cleaning liquid supply part, and a storage tank that stores cleaning liquid, and the housing and the storage tank are integrally configured as an assembly. The storage tank may be designed as a tank of the type which is fixedly provided for exclusive use within the housing and refilled with cleaning liquid as needed. Alternatively, it may be designed as a cartridge-type tank which can be replaced with new one when it runs out of cleaning liquid. As for the specific construction of this cartridge-type tank, for example, it may typically include a storage container molded of hard resin, and also include a pouch-type bottle formed of pouch sheet material and a storage container formed of transparent or semitransparent resin material through which the remaining amount of cleaning liquid can be visually checked. With this construction, the cleaning tool can be provided in which the housing that forms the outer shell of the cleaning liquid supply part and the storage tank that stores the cleaning liquid are integrally configured.

The cleaning liquid supply part in the cleaning tool may preferably be configured such that an outer peripheral surface of the housing is contiguous to an outer peripheral surface of the storage tank.

With such a configuration that is contiguous from the outer peripheral surface of the housing to the outer peripheral surface of the storage tank, the unity between the housing and the storage tank can be enhanced.

The cleaning liquid supply part in the cleaning tool may preferably be configured such that the sectional shape of the housing substantially conforms to the sectional shape of the storage tank.

With such a configuration in which the sectional shape of the housing substantially conforms to the sectional shape of the storage tank, the unity between the housing and the storage tank can be enhanced.

In the cleaning liquid supply part of the cleaning tool, preferably, an outer surface of the tank housing may be similar in color to an outer surface of the storage tank. The "similar color" in this invention includes not only the same color but colors of the same kind. For example, a combination of warm colors, a combination of cold colors, a combination of white and milky white, a combination of a transparent color and a semitransparent color can be defined as a combination of similar colors.

With such a construction in which the outer surface of the tank housing is similar in color to the outer surface of the storage tank, the unity between the housing and the storage tank can be enhanced.

The cleaning liquid supply part of the cleaning tool may preferably include an elongate housing that forms an outer shell of the cleaning liquid supply part. Particularly preferably, the elongate housing may be configured to be attached to the grip and serve as a supplementary grip that is supplementary to the grip.

With this construction, the grip and the supplementary grip attached to the grip can provide a wider region which can be held by the user.

Preferably, the elongate housing of the cleaning tool may be removable from the grip. Further, preferably, in user's cleaning operation, the cleaning tool offers first use mode and second use mode. The first use mode is defined as a use mode in which the user holds and uses the supplementary grip of the elongate housing attached to the grip. In this first use mode, the cleaning tool has a function of supplying cleaning liquid.

Once the face to be cleaned onto which the cleaning liquid has been supplied is wiped with the cleaning element, the cleaning element can be used as a wet-type cleaning element with a damp sheet surface. On the other hand, the second use mode is defined as a use mode in which the user holds and uses the grip to which the elongate housing is not attached. In this second use mode, the cleaning tool does not have a function of supplying cleaning liquid, the cleaning element is used as a dry-type cleaning element with a dry sheet surface.

With this construction, the user can use the two separate use modes depending on the kind of dirt on the face to be cleaned or other similar conditions. Thus, the cleaning tool having higher usability can be provided. Further, if the cleaning tool for use in the second use mode, with the elongate housing removed from the grip, is designed and manufactured as a final product, advantageously, the cleaning tool can be converted into a product with the cleaning liquid supply mechanism for use in the first use mode.

Preferably, the grip of the cleaning tool may have two locking parts formed along the length direction of the grip, while the elongate housing has two locking hooks that are disposed in the length direction of the housing and can be locked to the associated locking parts. In this case, preferably, the two locking hooks can be locked to the associated locking parts so that the elongate housing is attached to the grip. The manner of "locking" the locking hooks to the associated locking parts here widely includes the manner of fixedly connecting each other, for example, by hooking one on the other or fitting one in or on the other. Therefore, specifically, each of the locking parts to which the locking hooks are locked comprises a hole, a groove or a slit. Further, the two locking parts may be independently configured as separate holes, or the edge of a single hole may serve as the two locking parts. Further, as long as the cleaning tool is configured to have at least the two locking parts and at least the two locking hooks, another locking part or locking hook may be additionally provided.

With provision of the two locking parts formed along the length direction of the grip, the state of attachment of the elongate housing to the grip can be stabilized.

The cleaning tool may preferably include a first locking hook which is locked to one of the two locking parts and a second locking hook which is locked to the other locking part. Further, preferably, the first locking hook may be locked to the one locking part with the second locking hook held disengaged from the other locking part, and subsequently, while keeping the locked state, the elongate housing is rotated in a direction in which the second locking hook moves toward the other locking part. By this rotation, the second locking hook is locked to the other locking part.

In order to attach the elongate housing to the grip, the first locking hook is locked to the one locking part so that the elongate housing is positioned with respect to the grip, and then while keeping this locked state, the elongate housing is rotated, so that the second locking hook can be locked to the other locking part. Therefore, the elongate housing can be attached to the grip in a simple and reliable manner.

In the cleaning tool, preferably, the one locking part may comprise an elongate hole extending along the length direction of the grip, and the first locking hook has a front end projecting along the longitudinal direction of the elongate hole. Further, preferably, the first locking hook may be moved with respect to the elongate hole in the longitudinal direction of the elongate hole, and by this relative movement, the first locking hook is locked to the elongate hole.

The first locking hook can be moved in the longitudinal direction of the elongate hole with respect to the elongate hole in order to be locked to the elongate hole. Therefore, the elongate housing can be positioned with respect to the grip in a simple and reliable manner.

In the cleaning tool, preferably, the first locking hook may be locked on an edge of one end of the one locking part in the form of the elongate hole, and the second locking hook is locked on an edge of the other end of the elongate hole. Specifically, the other locking part that locks the second locking hook is preferably configured by using the edge of the single elongate hole which also serves as the one locking part.

With this construction, the edge of the single elongate hole can be rationally used as the two locking parts.

In the cleaning tool, the connecting part may be curved, and the elongate housing may be curved to conform to the curve of the connecting part and such that an end of the elongate housing on the side of the supply nozzle is located at a lowest level. Particularly, preferably, the connecting part may be convexly curved upward above the cleaning element. In other words, the connecting part may preferably be curved such that a concave space is created underneath the connecting part. This construction rationally allows easy placement of the supply nozzle when the cleaning liquid supply part is disposed under the connecting part.

Further, by forming the elongate housing having a curved shape that conforms to the curve of the connecting part, unnecessary space can be prevented from being created in the outer shape of the cleaning tool. Thus, the overall size of the cleaning tool can be effectively reduced.

In the cleaning tool, preferably, the holding part, the grip and the connecting part may be resin molded. With this construction, the entire cleaning tool can be reduced in weight.

In the cleaning tool, preferably, the holding part, the grip and the connecting part are integrally molded. With this construction, the costs of manufacturing the cleaning tool can be reduced.

According to this invention, in a cleaning tool having a sheet-type cleaning element for wiping a face to be cleaned, the cleaning effect can be enhanced particularly by attachment of a cleaning liquid supply part having a supply nozzle that can supply cleaning liquid directly onto a face to be cleaned.

BEST MODES FOR PERFORMING THE INVENTION

A representative embodiment of the present invention is now described with reference to the drawings. First, the structure of a cleaning tool 10 according to this embodiment is explained with reference to FIGS. 1 to 5.

Figure 1:
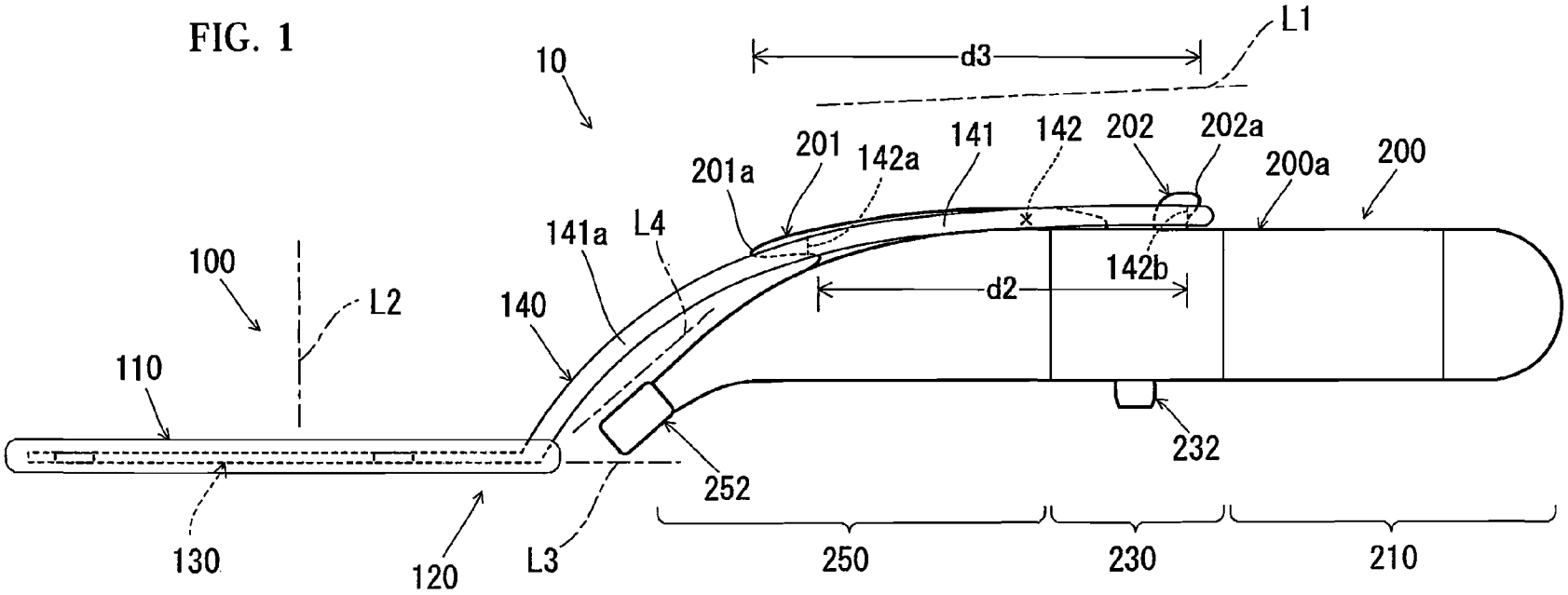
FIG. 1 is a side view of a cleaning tool 10 according to this embodiment of the invention.
Figure 2:
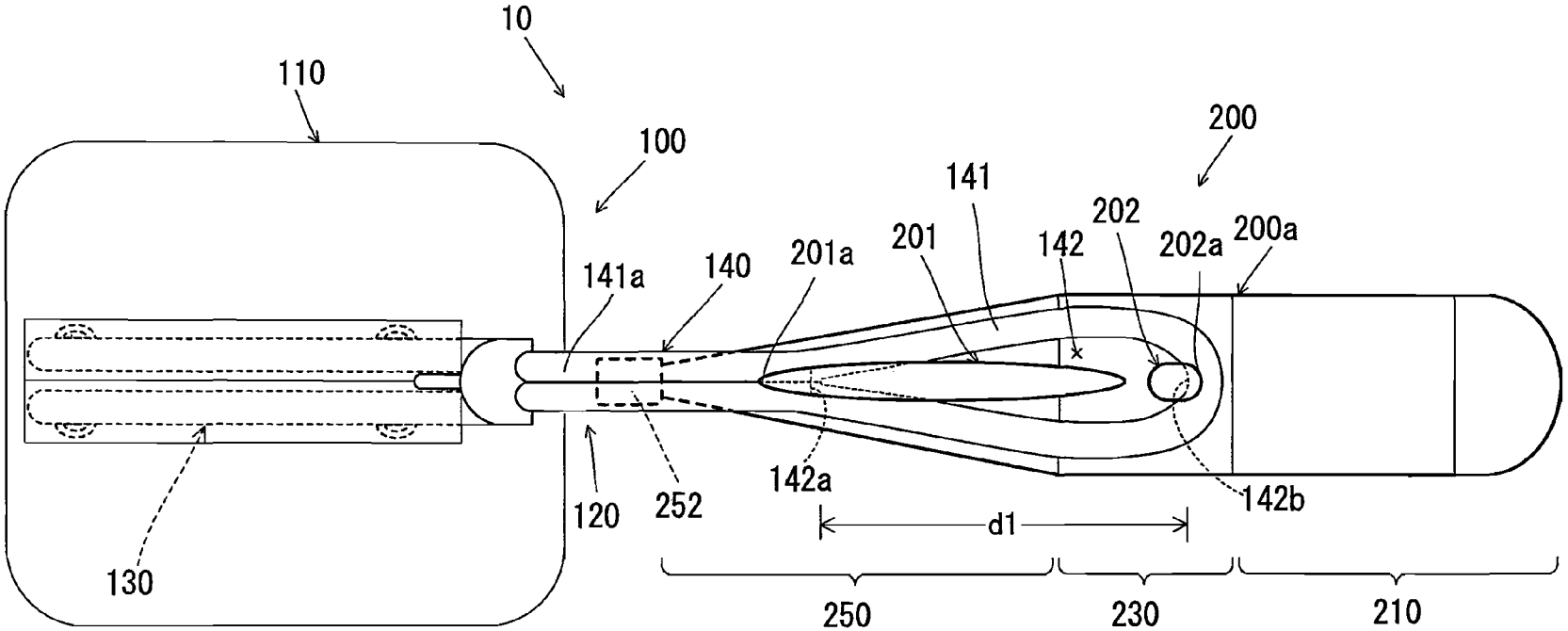
FIG. 2 is a plan view of the cleaning tool 10 in FIG. 1.

FIG. 1 is a side view of the cleaning tool 10 according to this embodiment, and FIG. 2 is a plan view of the cleaning tool 10 in FIG. 1. As shown in FIGS. 1 and 2, the cleaning tool 10 consists of a first structure 100 and a second structure 200. The first structure 100 includes the cleaning sheet holder 120 and the cleaning sheet 110 attached to the cleaning sheet holder 120, which will be described below in more detail.

A housing 200*a* of the second structure 200 is generally cylindrical and includes, from rear to front, a tank housing 210, a pump housing 230 and a discharge housing 250. The housing 200*a* forms an outer shell of the second structure 200 and is designed as an operation part (handle part) which is held by the user for cleaning operation using the cleaning tool 10. Although it will be described below in more detail, a pump mechanism is disposed in the pump housing 230, and when an operation button 232 disposed on the underside of the housing is manually operated, the pump mechanism sucks in cleaning liquid which is stored in a storage tank within the tank housing 210, pressurizes it and then discharges the pressurized cleaning liquid. The cleaning liquid discharged from the pump mechanism is injected from an injection nozzle 252 through a discharge path formed in the discharge housing 250. The injection nozzle 252 here is a feature that corresponds to the "supply nozzle" according to this invention. As the cleaning liquid to be injected from the injection nozzle 252, a cleaner for cleaning floor, a polishing wax-containing cleaner, a fragrance-containing cleaning liquid, a deodorant-containing cleaning liquid, or dilution of any of those liquids with water, or water itself can be used.

In this embodiment, an extension line L1 in the length direction of a handle body 141 intersects with a normal L2 to a sheet plane of the cleaning sheet 110 at a predetermined angle. In the representative example shown in FIG. 1, this angle is about 90°. Further, in this embodiment, a region of connection between a holder body 130 (of the cleaning sheet holder 120) and a connecting part 141*a* (the handle body 141) generally coincides with the rear end (right end as viewed in FIG. 1) of the cleaning sheet 110. In addition, the holder body 130, the connecting part 141*a* and the handle body 141 are integrally fixed to each other. Therefore, the cleaning tool 10 in this embodiment is designed specifically as a hand-held cleaning tool of which length from the handle body 141 to the holder body 130 via the connecting part 141*a* is limited within a predetermined range so that a user can hold and use the cleaning tool with one hand for cleaning operation.

Further, in this embodiment, the injection nozzle 252 is located below the handle body 141 and rearward of the connecting part 141*a*. Further, in terms of the direction of installation height, the injection nozzle 252 is located above the lower surface of the cleaning sheet 110 and in a height region in which an extension line L3 of the holder body 130 intersects with an extension line L4 of the connecting part 141*a*. Further, in this embodiment, the orientation of the injection nozzle 252 conforms to the extension line L4 of the connecting part 141*a* (the extending direction of the connecting part according to this invention). In this invention, the number, installation position and orientation of the injection nozzle 252 can be appropriately changed as necessary. For example, the supply nozzle in the form of the injection nozzle 252 may be located forward of the connecting part 141*a*, or it may be disposed on the front or rear end of the holder body 130.

Further, a first locking hook 201 and a second locking hook 202 are formed on the top of the housing of the second structure 200 and arranged on a straight line in the longitudinal direction. The first locking hook 201 and the second locking hook 202 can engage with a longitudinally elongate hole (engagement hole) 142 formed through the cleaning sheet holder 120 of the first structure 100. With this construction, the first locking hook 201 and the second locking hook 202 are engaged and locked in the single elongate hole 142, so that the cleaning sheet holder 120 of the first structure 100 is retained on the second structure 200 side.

Specifically, the first locking hook 201 and the second locking hook 201 are both formed of an elastic material such as rubber and resin, and the first locking hook 201 projects forward to a front end 201*a*, while the second locking hook 202 projects rearward to a rear end 202*a*. Further, the distance between the front of the base of the first locking hook 201 and the rear of the base of the second locking hook 202 (distance d2 in FIG. 1) is substantially equal to or slightly longer than the length of the elongate hole 142 in the longitudinal direction (distance d1 in FIG. 2). Further, the distance between the front end 201*a* of the first locking hook 201 and the rear end 202*a* of the second locking hook 202 (distance d3 in FIG. 1) is longer than the length of the elongate hole 142 in the longitudinal direction (distance d1 in FIG. 2).

Therefore, in order to attach the cleaning sheet holder 120 of the first structure 100 to the second structure 200, the first locking hook 201 is locked to a front end 142*a* of the elongate hole 142 and the second locking hook 202 is locked to a rear end 142*b* of the elongate hole 142. As a result, the elastic biasing forces of the first locking hook 201 and the second locking hook 202 act upon the cleaning sheet holder 120 in its longitudinal direction and in the downward direction. By this elastically pressing action of the hooks, the cleaning sheet holder 120 can be securely retained on the second structure 200 side.

The first locking hook 201 here is a feature that corresponds to the "locking hook" and the "first locking hook", and the second locking hook 202 here is a feature that corresponds to the "locking hook" and the "second locking hook" according to this invention. Further, the elongate hole 142 is a feature that corresponds to the "elongate hole", the front end 142*a* of the elongate hole 142 is a feature that corresponds to the "locking part" and the "one locking part", and the rear end 142*b* of the elongate hole 142 is a feature that corresponds to the "locking part" and "the other locking part" according to this invention.

Figure 3:
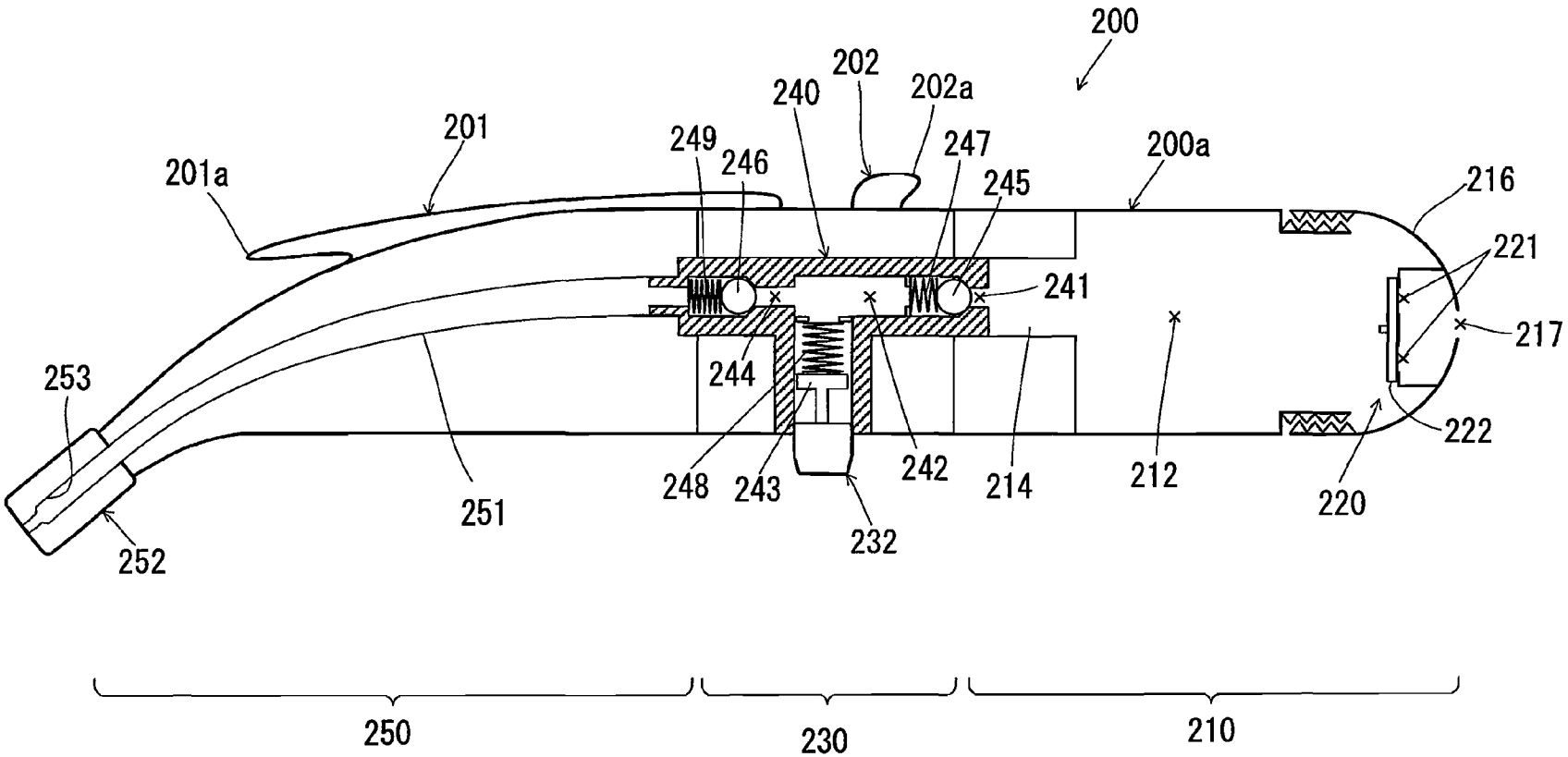
FIG. 3 schematically shows the internal structure of a second structure 200 in this embodiment.

The internal structure of the second structure 200 is now explained with reference to FIG. 3. FIG. 3 schematically shows the internal structure of the second structure 200 in this embodiment. FIG. 3 shows the initial state in which the operation button 232 is not pressed.

As shown in FIG. 3, the tank housing 210 contains a storage tank 212 for storing cleaning liquid, a supply tube 214 for supplying the cleaning liquid from the storage tank 212 to the pump mechanism 240 disposed in the pump housing 230, a tank cap 216 that hermetically closes the storage tank 212 and has an air hole 217 on its rear end, and a valve mechanism 220 mounted to the tank cap 216. The storage tank 212 is a feature that corresponds to the "storage tank" according to this invention. The storage tank 212 is integrally configured with the housing 200*a* that forms the outer shell of the second structure 200 or with the tank housing 210 as an assembly.

Further, in this embodiment, preferably, the outer peripheral surface of the tank housing 210 is contiguous to the outer peripheral surface of the storage tank 212, and the tank housing 210 has a circular or elliptical section that substantially conforms to the sectional shape of the storage tank 212. Further, in this embodiment, preferably, the outer surface of the tank housing 210 is similar in color to the outer surface of the storage tank 212. The "similar color" here includes not only the same color but colors of the same kind. For example, a combination of warm colors, a combination of cold colors, a combination of white and milky white, a combination of a transparent color and a semitransparent color can be defined as a combination of similar colors here. With such a preferable construction, the unity between the tank housing 210 and the storage tank 212 can be enhanced.

The tank cap 216 is threadably mounted on the housing body of the tank housing 210. The tank cap 216 can be mounted on the housing body by screwing the tank cap 216, while the tank cap 216 can be removed from the housing body by unscrewing the tank cap 216. Further, preferably, an O-ring (not shown) for preventing leakage of cleaning liquid may be mounted on the threaded portion of the tank cap 216 and connecting portions in the areas of the pump mechanism 240, the injection nozzle 252, etc. through which cleaning liquid runs. The material of the O-ring can be appropriately selected based on its resistance to cleaning liquid to be used, and typically, a rubber material or a resin material can be used. The valve mechanism 220 includes a communication hole 221 that communicates with the air hole 217 of the tank cap 216, and a valve disc 222 that can open and close the communication hole 221. The valve disc 222 is typically molded of a silicon material or a rubber material.

Further, as shown in FIG. 3, the pump mechanism 240 in the pump housing 230 includes at least an inlet port 241, a flow passage 242, a pressurizing member 243, an outlet port 244, metal or resin first ball 245 and second ball 246, and metal or resin coil springs 247, 248, 249. The pump mechanism 240 is mechanically actuated by the force applied to the operation button 232 when the operation button 232 is manually operated. The pump mechanism 240 is also referred to as the "manual pump" or "mechanical pump". The pump mechanism 240 is a feature that corresponds to the "pump mechanism" according to this invention.

The cleaning liquid supplied through the supply tube 214 is sucked into the flow passage 242 via the inlet port 241. The cleaning liquid sucked into the flow passage 242 via the inlet port 241 passes through the flow passage 242. The pressurizing member 243 pressurizes (or compresses) the cleaning liquid in the flow passage 242 when the operation button 232 is pressed. The cleaning liquid pressurized by the pressurizing member 243 is discharged from the flow passage 242 via the outlet port 244. The coil spring 247 elastically biases the first ball 245 in the direction that closes the inlet port 241 (to the right as viewed in FIG. 3). The coil spring 248 elastically biases the pressurizing member 243 in the direction that releases the operation button 232 (downward as viewed in FIG. 3). The coil spring 249 elastically biases the second ball 246 in the direction that closes the outlet port 244 (to the right as viewed in FIG. 3). Therefore, in the initial state in which the operation button 232 is not pressed, the first ball 245 closes the inlet port 241 by the biasing force of the coil spring 247, and the second ball 246 closes the outlet port 244 by the biasing force of the coil spring 249.

Further, as shown in FIG. 3, a guide tube 251 is disposed within the discharge housing 250, and through the guide tube 251, the cleaning liquid discharged from the outlet port 244 is guided to the injection nozzle 252 mounted on the housing front end. This guide tube 251 and the above-mentioned supply tube 214 are preferably formed by using flexible materials, or typically, silicon resin, polyurethane resin (PU), polyethylene resin (PE), etc. The cleaning liquid led to the injection nozzle 252 through the guide tube 251 is injected onto a desired region to be cleaned, through a throttle hole 253 provided within the injection nozzle 252. The throttle hole 253 of the injection nozzle 252 is directed obliquely forward.

As described above, the storage tank 212, the pump mechanism 240, the injection nozzle 252 and other component parts which are housed or mounted in the tank housing 210, the pump housing 230 or the discharge housing 250 form the "cleaning liquid supply part" according to this invention.

Figure 4:
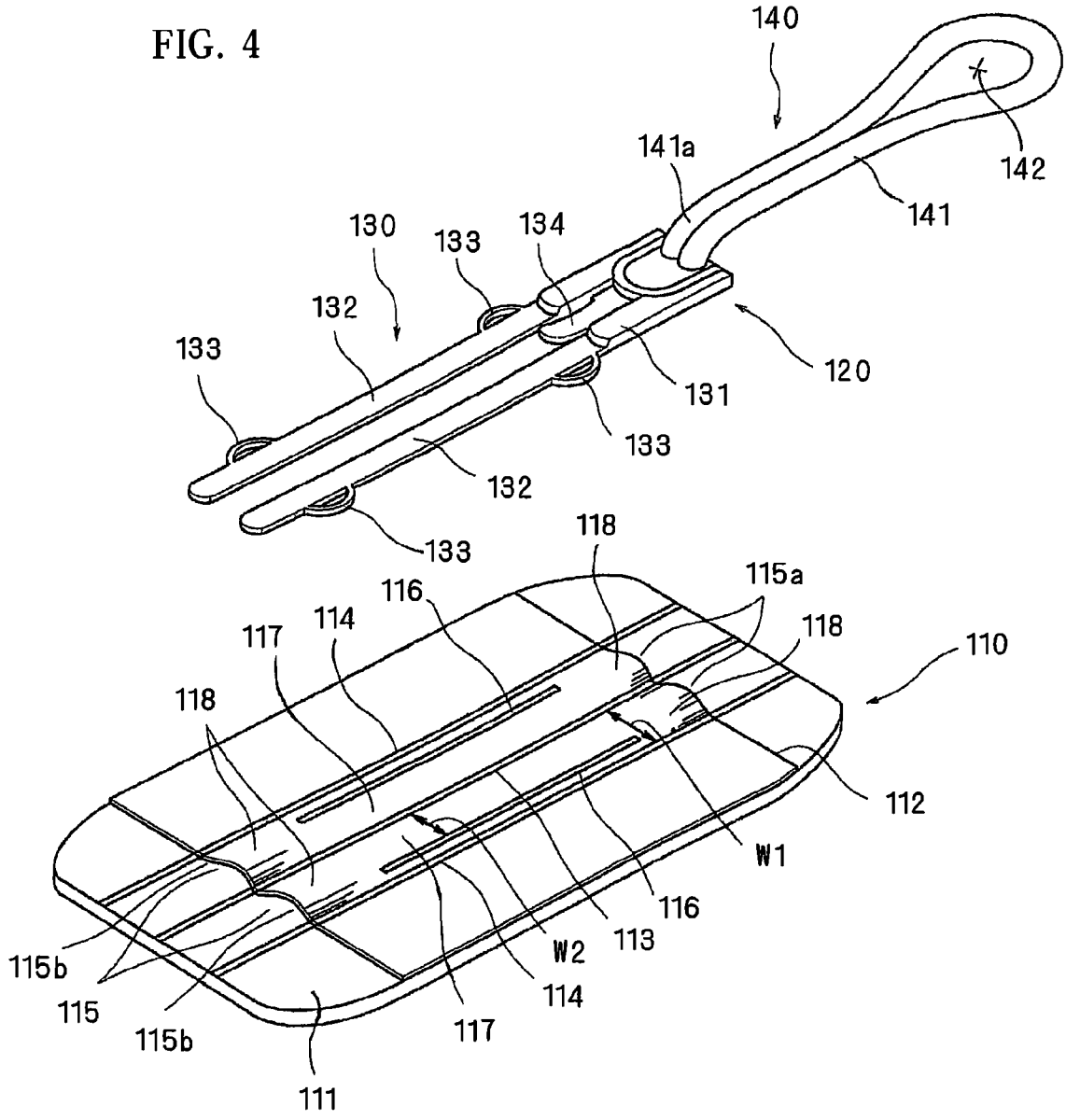
FIG. 4 is a perspective view showing the construction of a first structure 100 in this embodiment.
Figure 5:
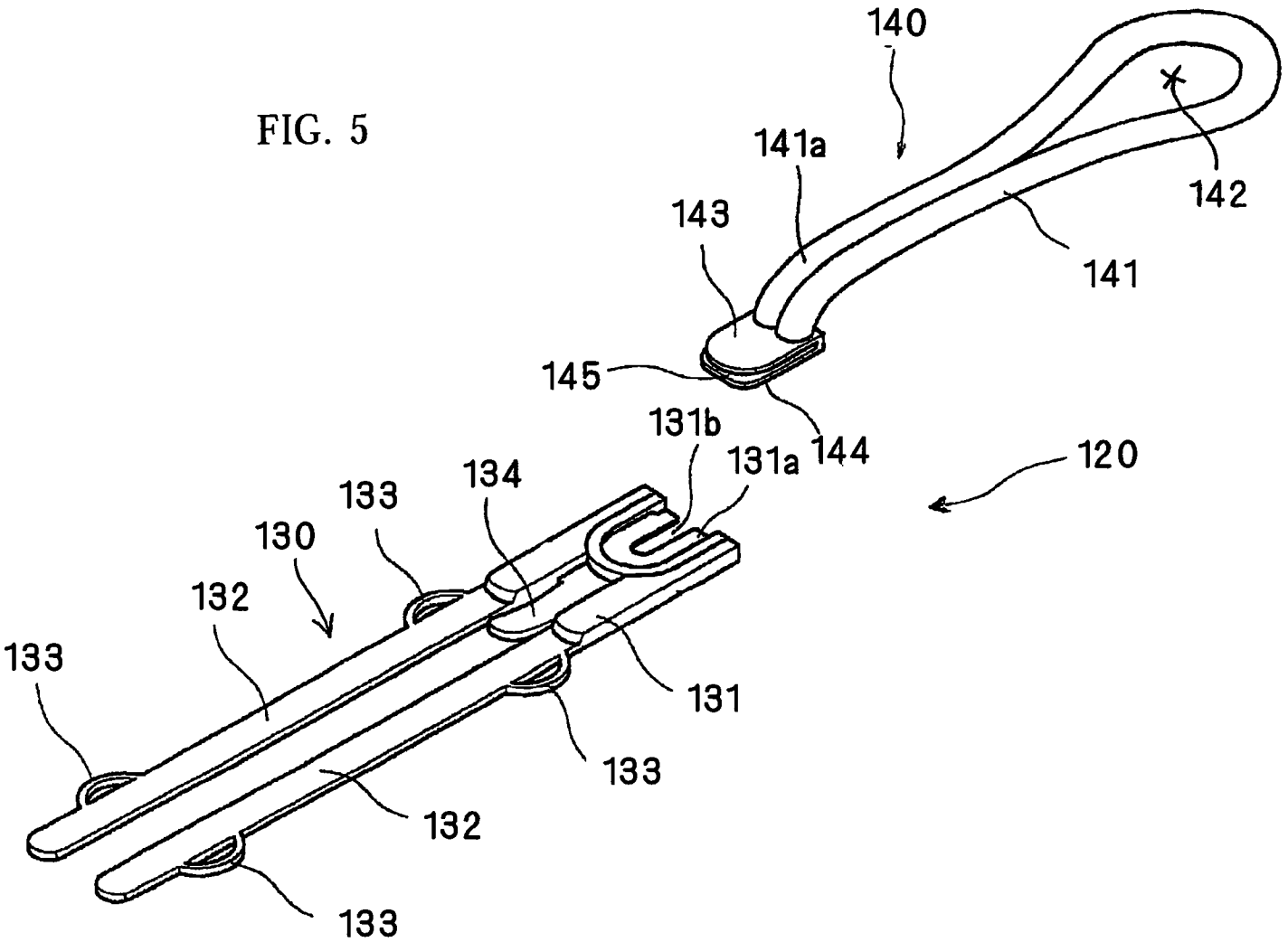
FIG. 5 is a perspective view showing a cleaning sheet holder 120 in FIG. 4 which is shown separated into a holder body 130 and a handle 140.

Now, the construction of the first structure 100 is explained in detail with reference to FIGS. 4 and 5. FIG. 4 is a perspective view showing the construction of the first structure 100 in this embodiment, and FIG. 5 is a perspective view showing the cleaning sheet holder 120 in FIG. 4 which is shown separated into a holder body 130 and a handle 140.

As shown in FIG. 4, the first structure 100 includes the cleaning sheet 110 and the cleaning sheet holder 120.

The cleaning sheet 110 includes a cleaning sheet body 111 and a joining sheet 112 overlaid on and joined to the upper face of the cleaning sheet body 111. The cleaning sheet 110 is preferably designed as a sheet-type cleaning element having a function of absorbing liquids including a cleaning liquid and a function of removing dirt on a face S to be cleaned by wiping. The cleaning sheet body 111 and the joining sheet 112 which form the cleaning sheet 110 can typically be formed of nonwoven fabric comprising thermal melting fibers. As the thermal melting fibers, polyethylene, polypropylene, polyethylene terephthalate or other similar materials can be used. The nonwoven fabric may be manufactured by through-air bonding, spunbonding, spun lacing or other similar processes. Further, as a liquid absorbing sheet that forms the cleaning sheet 110, typically, pulp, rayon, cotton or other cellulosic fibers which have a property of swelling by containing water, can be used. In this case, if the sheet needs to be fusion bonded to the cleaning sheet body 111, for example, non-woven fabric which is formed by laminating pulp fibers and thermal melting fibers by an air-laid method can be used. Further, as a dirt removing sheet that forms the cleaning sheet 110, typically, a fiber bundle formed by opening a tow, or non-woven fabric formed of split fibers can be used. Further, the kinds and numbers of the component parts of the cleaning sheet 110 are not limited to those described in the above-described example, and can be selected as necessary. The cleaning sheet 110 is rectangular and is arranged such that its longer side extends along the length direction of the handle body 141 (the housing 200*a*). The cleaning sheet 110 is a feature that corresponds to the "sheet-like cleaning element" according to this invention.

Further, the cleaning sheet body 111 and the joining sheet 112 are fusion bonded together at a central fusion-bonding line 113 and a pair of side mounting lines 114. The central fusion-bonding line 113 extends in the center of the cleaning element 110 in its longitudinal direction and the side mounting lines 114 extend parallel to the central fusion-bonding line 113 with a spacing W1 on its opposite sides of the central fusion-bonding line 113. Thus, a pair of holding spaces 115 extending in the longitudinal direction are defined between the central fusion-bonding line 113 and the side mounting lines 114. Each of the holding spaces 115 has a rear open end 115*a* and a front open end 115*b*. A holding plate 132 of a holder body 130 which will be described below can be inserted into the holding space 115. Further, the cleaning sheet body 111 and the joining sheet 112 are fusion bonded together at narrowing fusion-bonding lines 116 provided between the central fusion-bonding line 113 and the side mounting lines 114. Thus, each of the holding spaces 115 has a narrow part 117 having a width W2 (<W1) in the central region in the longitudinal direction and wide parts 118 having the width W1 on the front and rear sides of the narrow part 117.

Preferably, the cleaning sheet 110 is replaced with an appropriate one according to whether cleaning is performed with cleaning liquid or on a liquid-existing or wet area, or cleaning is performed without using cleaning liquid or on a dry area. For cleaning with cleaning liquid or on a liquid-existing or wet area, a wet-type cleaning sheet can be used as the cleaning sheet 110, which sheet is useful to effectively remove dirt under wet conditions in which cleaning liquid or other liquids exist on the face S to be cleaned. On the other hand, for cleaning without using cleaning liquid or on a dry area, a dry-type cleaning sheet can be used as the cleaning sheet 110, which sheet is useful to effectively remove dirt under dry conditions in which any liquid hardly exists on the face S to be cleaned. The faces S to be cleaned which can be wiped with the cleaning sheet 110 include faces to be cleaned (floors, walls, ceilings, external walls, furniture, clothes, curtains, bedding, home electric appliances, etc.) inside and outside of houses, apartments, buildings, factories, vehicles, etc. or faces of human body parts to be cleaned. The face S to be cleaned here is a feature that corresponds to the "face to be cleaned" according to this invention.

The cleaning sheet holder 120 includes the holder body 130 and the handle 140. The handle 140 includes the longitudinally extending handle body 141 and the connecting part 141*a* disposed between the handle body 141 and the holder body 130. The above-described elongate hole 142 is provided in the handle body 141. The handle body 141 and the holder body 130 are fixedly connected at the connecting part 141*a*. The connecting part 141*a* is a feature that corresponds to the "connecting part" according to this invention. In this embodiment, the holder body 130 and the handle 140 (the handle body 141 and the connecting part 141*a*) are separately molded of resin material and thereafter integrally connected together. With this construction, the entire cleaning tool can be reduced in weight and the costs of manufacturing the cleaning tool can be reduced. Instead of this construction, the holder body 130 and the handle 140 (the handle body 141 and the connecting part 141*a*) may be integrally molded, or two of the holder body 130, the handle body 141 and the connecting part 141*a* may be integrally molded, or all of them may be separately molded and thereafter fixedly connected together.

Further, the connecting part 141*a* is curved such that its end on the holder body 130 side is located at a lowest level. In this embodiment, the housing 200*a* of the second structure 200 is shaped to conform to the curve of the connecting part 141*a*. Specifically, the discharge housing 250 of the housing 200*a* is curved such that its end on the injection nozzle 252 side is located at a lowest level (see FIG. 1). According to this invention, by forming the housing 200*a* having a curved shape that conforms to the curve of the connecting part 141*a*, unnecessary space can be prevented from being created in the outer shape of the cleaning tool 10. Thus, the overall size of the cleaning tool 10 can be effectively reduced. Further, the connecting part 141*a* is convexly curved upward above the cleaning sheet 110. In other words, the connecting part 141*a* is curved such that a concave space is created underneath the connecting part 141*a*. This construction advantageously allows easy placement of the injection nozzle 252 when the cleaning liquid supply part is placed under the connecting part 141*a*.

The holder body 130 has a function of detachably holding the cleaning sheet 110 and is a feature that corresponds to the "holding part" in this invention. The holder body 130 includes a base 131 on the handle 140 side, a pair of holding plates 132 and a retaining plate 134. The holding plates 132 extend forward in the longitudinal direction from the base 131 and parallel with a predetermined spacing therebetween. In other words, the holder body 130 has a bifurcated form. Each of the holding plates 132 may have a constant width in the longitudinal direction or be tapered. Further, two projections 133 are formed on the front and rear portions of the outer edge of each of the holding plates 132. Each of the projections 133 projects outward from the holding plate 132 and has a convexly curved projecting surface. The retaining plate 134 extends forward between the pair holding plates 132 and is convexly curved downward. The retaining plate 134 further has a locking projection (not shown) on the underside.

The holding plate 132 can be inserted into the associated holding space 115 and has a function of holding the cleaning sheet 110 in the inserted state. The width of a portion of the holding plate 132 which has the projection 133 is equal to the width W1 of the wide part 118 of the holding space 115. The width of the other portions of the holding plate 132 which do not have the projection 133 is equal to the width W2 of the narrow portion 117 of the holding space 115. In the inserted state, the holding plate 132 is fitted in the associated holding space 115 by close sliding contact, so that the cleaning sheet 110 is securely attached to the holding plate 132. Further, in the inserted state, the retaining plate 134 presses the cleaning sheet 110 from above, and the locking projection formed on the underside of the retaining plate 134 serves as a stopper for preventing the cleaning sheet 110 from coming off. Thus, in the inserted state in which the holding plate 132 is inserted into the holding space 115, the cleaning sheet 110 is reliably retained by the holder body 130.

Further, as shown in FIG. 5, the holder body 130 and the handle 140 are separately resin molded and thereafter disengageably connected together. The holder body 130 has an engagement plate 131*a* on the rear end of the base 131. The handle 140 has a first engaging plate 143 and a second engaging plate 144 on the front end of the handle body 141. An engagement space 145 is defined between the first engaging plate 143 and the second engaging plate 144 and can receive the engagement plate 131*a*. A projection (not shown) is provided in the engagement space 145 and can be engaged with a recess 131*b* of the engagement plate 131*a*. Thus, when the engagement plate 131*a* is inserted into the engagement space 145, the engagement plate 131*a* is sandwiched between the first engaging plate 143 and the second engaging plate 144. Further, the projection of the engagement space 145 is engaged with the recess 131*b* of the engagement plate 131*a*. Thus, the holder body 130 and the handle 140 are joined together by a joining force acting therebetween. In this state, the holder body 130 and the handle 140 can be disengaged from each other by pulling the holder body 130 and the handle 140 apart from each other by a pulling force larger than the joining force.

As for materials of component parts of the cleaning tool 10, in consideration of users' ease of operation, preferably, light resin materials may be mainly used. For example, the cleaning sheet holder 120, the tank housing 210, the pump housing 230, the operation button 232, the discharge housing 250 and the injection nozzle 252 may be formed of polypropylene resin (PP), polyethylene resin (PE), acrylonitrile butadiene styrene resin (ABS), polyacetal resin (POM), polyamide resin (PA), polycarbonate resin (PC), etc.

Figure 6:
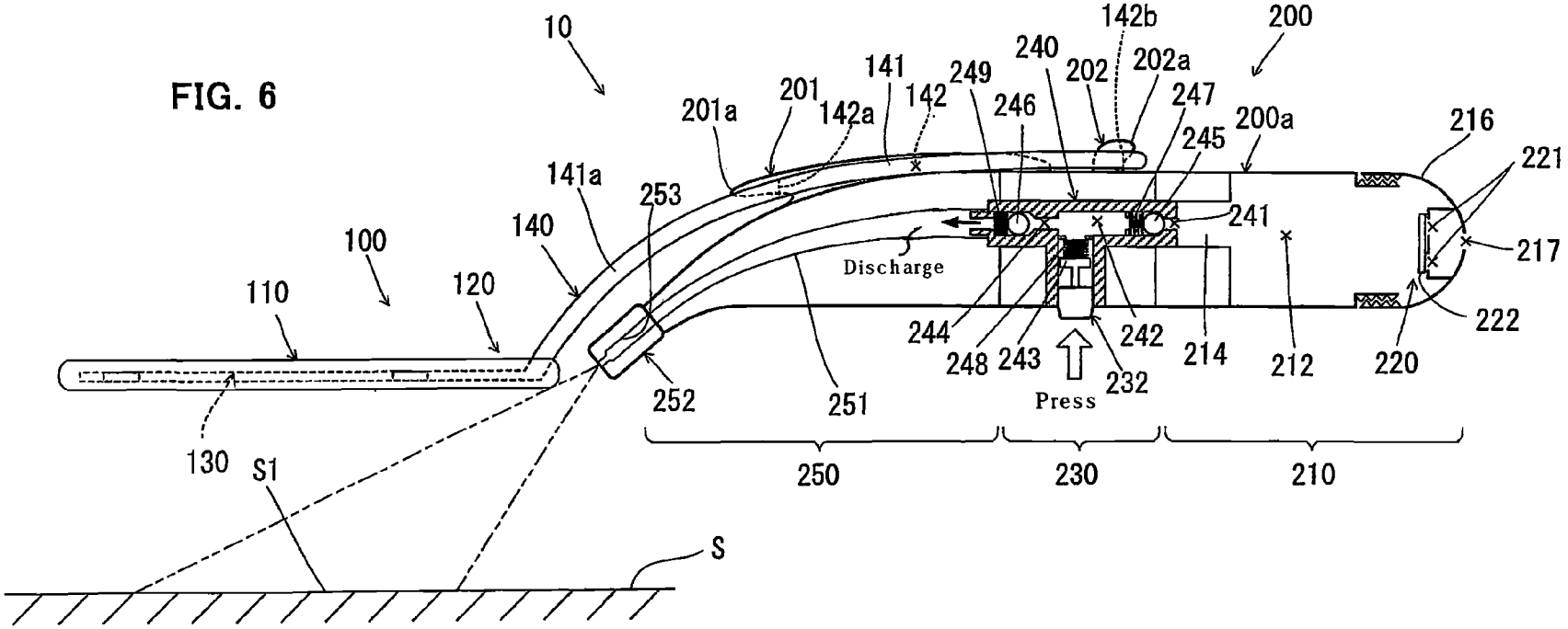
FIG. 6 is a side view of the cleaning tool 10 in this embodiment, showing together the internal structure of the second structure 200 when an operation button 232 is pressed.
Figure 7:
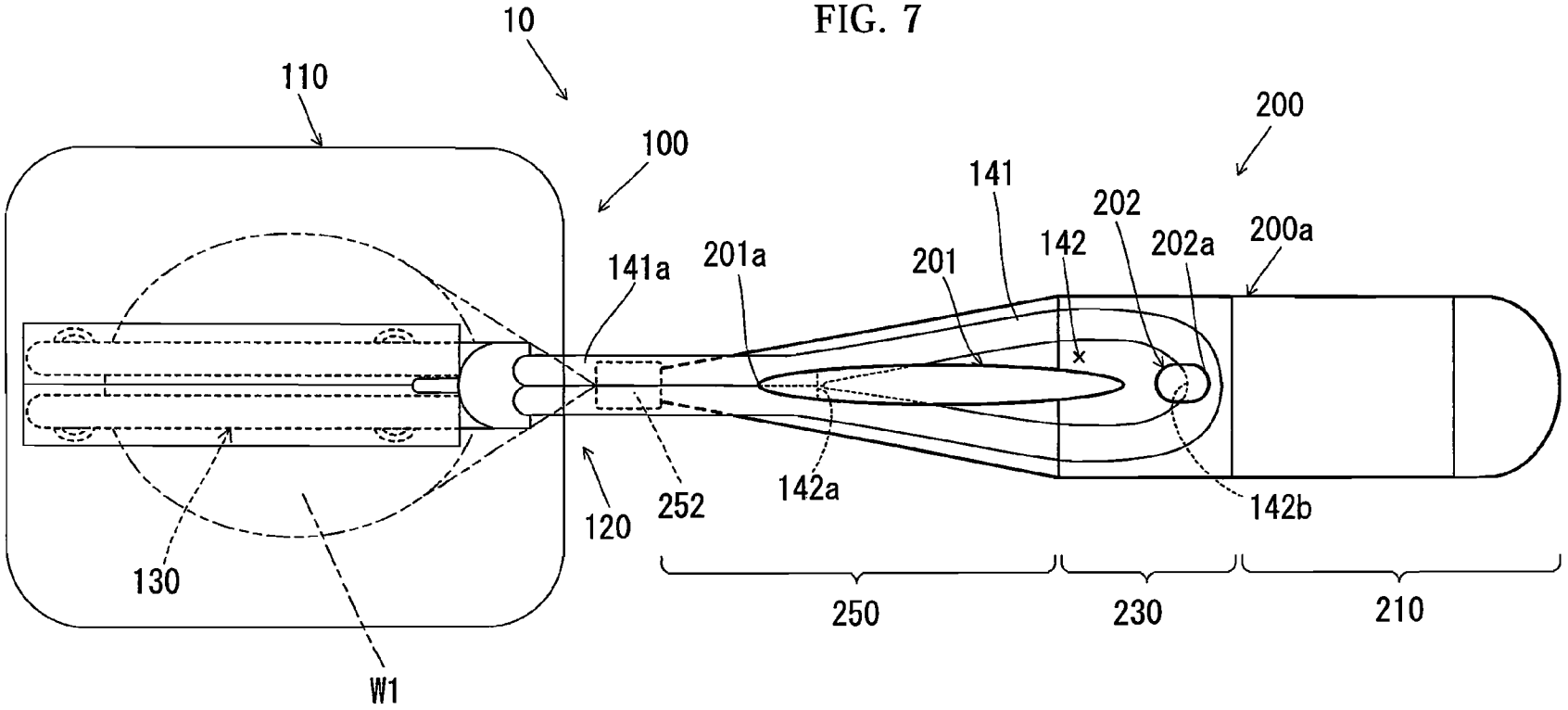
FIG. 7 is a plan view of the cleaning tool 10 in this embodiment, showing together the internal structure of the second structure 200 when the operation button 232 is pressed.
Figure 8:
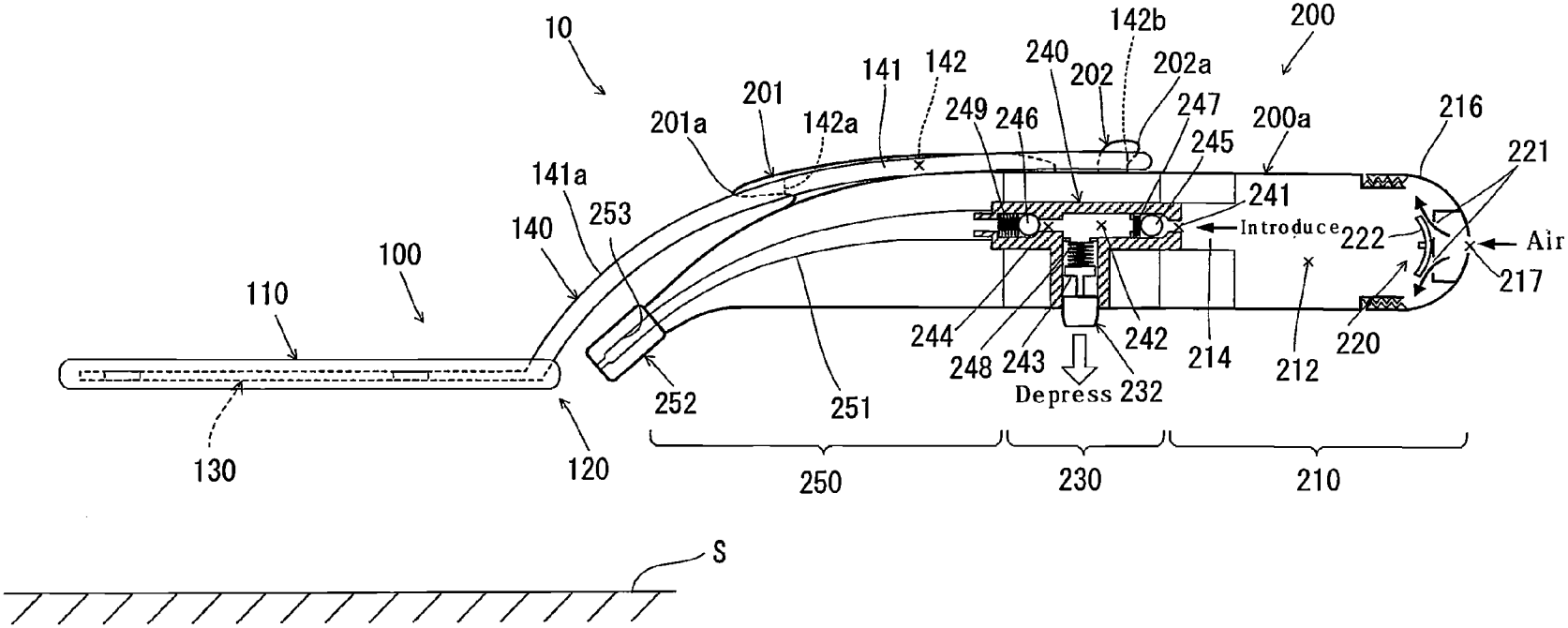
FIG. 8 is a side view of the cleaning tool 10 in this embodiment, showing together the internal structure of the second structure 200 immediately after release of the operation button 232.

Operation of the second structure 200 of the cleaning tool 10 is now described with reference to FIGS. 6 to 8. FIG. 6 is a side view of the cleaning tool 10 in this embodiment, showing together the internal structure of the second structure 200 when the operation button 232 is pressed. FIG. 7 is a plan view of the cleaning tool 10 in this embodiment, showing together the internal structure of the second structure 200 when the operation button 232 is pressed. FIG. 8 is a side view of the cleaning tool 10 in this embodiment, showing together the internal structure of the second structure 200 immediately after release of the operation button 232.

As shown in FIG. 6, when the user manually operates (presses or depresses with the finger), the pressurizing member 243 moves against the elastic biasing force of the coil spring 248 and pressurizes cleaning liquid in the flow passage 242. The operation button 232 is designed to be touched by the user's finger. A finger entry preventing region for preventing entry of the user's finger is provided between the operation button 232 and the pump housing 230 (the housing 200*a*). This provision of the finger entry preventing region is typically realized by the construction configured such that a base of the operation button 232 which is located on the pump housing 230 side is as large as or slightly larger than a top of the operation button 232 and such that the outer edge portion of the base of the operation button 232 extends substantially straight toward the outer edge portion of the top of the operation button 232. With this construction, between the top and the base of the operation button 232, an unnecessary hollow or space which the user's hand or finger may be caught in or enter and interfere with the user's operation is not created. Thus, such a construction can prevent occurrence of such a trouble that may interfere with the user's operation. The operation button 232 here is a feature that corresponds to the "operation part" and "operation button" according to this invention. Further, in consideration of users' ease of manual operation, it is preferably designed such that the operation button 232 is actuated by the application of force of about 10 N. This construction can be realized by appropriately adjusting the elastic biasing force of the coil spring 248 which elastically biases the pressuring member 243 in the direction that releases the operation button 232.

In the state in which the cleaning liquid is pressurized by the pressurizing member 243, the pressure in the flow passage 242 becomes higher than the pressures in the storage tank 212 and the guide tube 251. As a result, the first ball 245 closes the inlet port 241 by the elastic biasing force of the coil spring 247. Further, as for the valve mechanism 220, when the operation button 232 is pressed, the valve disc 222 closes the communication hole 221. The valve mechanism 220 can supply air into the storage tank 212 and has a function of preventing cleaning liquid from leaking out of the storage tank 212. Thus, the valve mechanism 220 is also referred to as a "nonreturn valve structure" or "back-flow check valve structure". Therefore, the cleaning liquid pressurized in the flow passage 242 is discharged into the guide tube 251 via the outlet port 244 and then led to the injection nozzle 252 through the guide tube 251. Then the cleaning liquid is injected from the throttle hole 253 toward the face S to be cleaned. In this case, cleaning liquid is injected by a substantially constant amount in one manual operation (with one push) of the operation button 232. Preferably, the amount of injection of the cleaning liquid is determined according to one wiping operation using the cleaning sheet 110. For example, using the injection of about 1.0 cc as a guide, the amount of injection can be appropriately set.

As shown in FIGS. 6 and 7, the cleaning liquid is injected from the throttle hole 253 obliquely downward and forward toward an injection region (spray region) S1 on the face S to be cleaned which is located below the cleaning sheet 110 attached on the front end side of the cleaning sheet holder 120.

Thereafter, when the user releases the operation button 232, the pressurizing member 243 moves by the elastic biasing force of the coil spring 248. As a result, the pressure in the flow passage 242 is reduced. In this state, the pressure in the flow passage 242 becomes lower than the pressures in the storage tank 212 and the guide tube 251. As a result, as shown in FIG. 8, the first ball 245 moves in the direction that opens the inlet port 241 (to the left as viewed in FIG. 8), against the elastic biasing force of the coil spring 247, and opens the inlet port 241. Meanwhile, the second ball 246 moves in the direction that closes the outlet port 244 (to the right as viewed in FIG. 8), by the elastic biasing force of the coil spring 247, and closes the outlet port 244. Further, as for the valve mechanism 220, immediately after release of the operation button 232, the valve disc 222 opens the communication hole 221, so that outside air is introduced into the storage tank 212 through the air hole 217 of the tank cap 216 and the communication hole 221. As a result, the cleaning liquid in the storage tank 212 is introduced into the flow passage 242 by the amount corresponding to the injected amount. At this time, a space is created within the storage tank 212 by the air introduced from the outside. Then, when the operation button 232 returns to the initial position shown in FIG. 3, the pressure in the flow passage 242 becomes substantially equal to the pressures in the storage tank 212 and the guide tube 251. The valve disc 222 then closes the communication hole 221 again.

Thus, a desired amount of cleaning liquid is injected onto the injection region S1 of the face S to be cleaned. Further, by repeating the pressing and releasing operations of the operation button 232, additional cleaning liquid can be injected, for example, when the amount of injection of the cleaning liquid is not enough. Thereafter, the user wipes the injection region S1 on which the cleaning liquid has been injected and its surroundings, with the cleaning sheet 110. Thus, a cleaning operation of removing dirt and dust from the face S to be cleaned can be performed.

Figure 9:
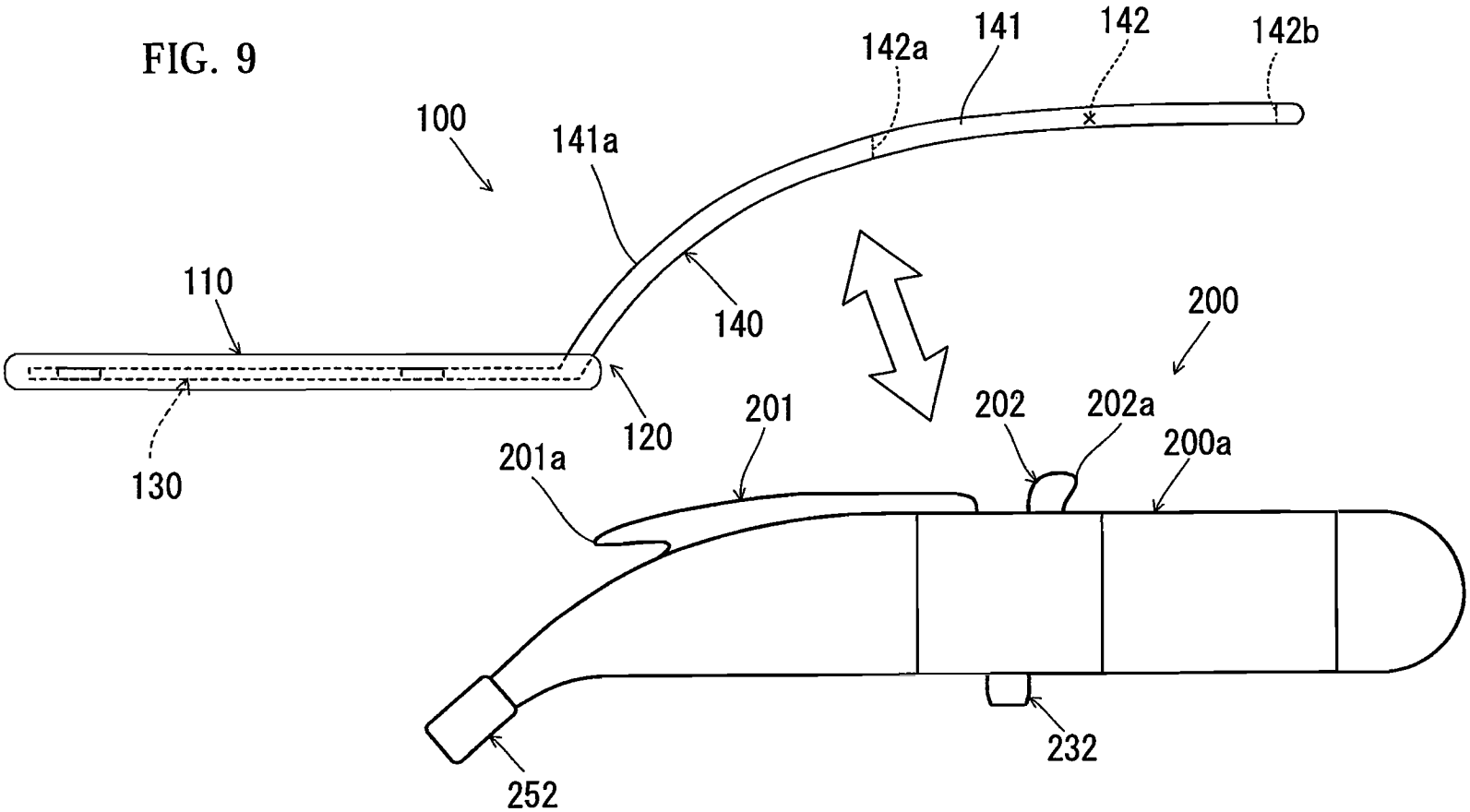
FIG. 9 shows the state in which the second structure 200 is removed from the first structure 100, as viewed from the side.
Figure 10:
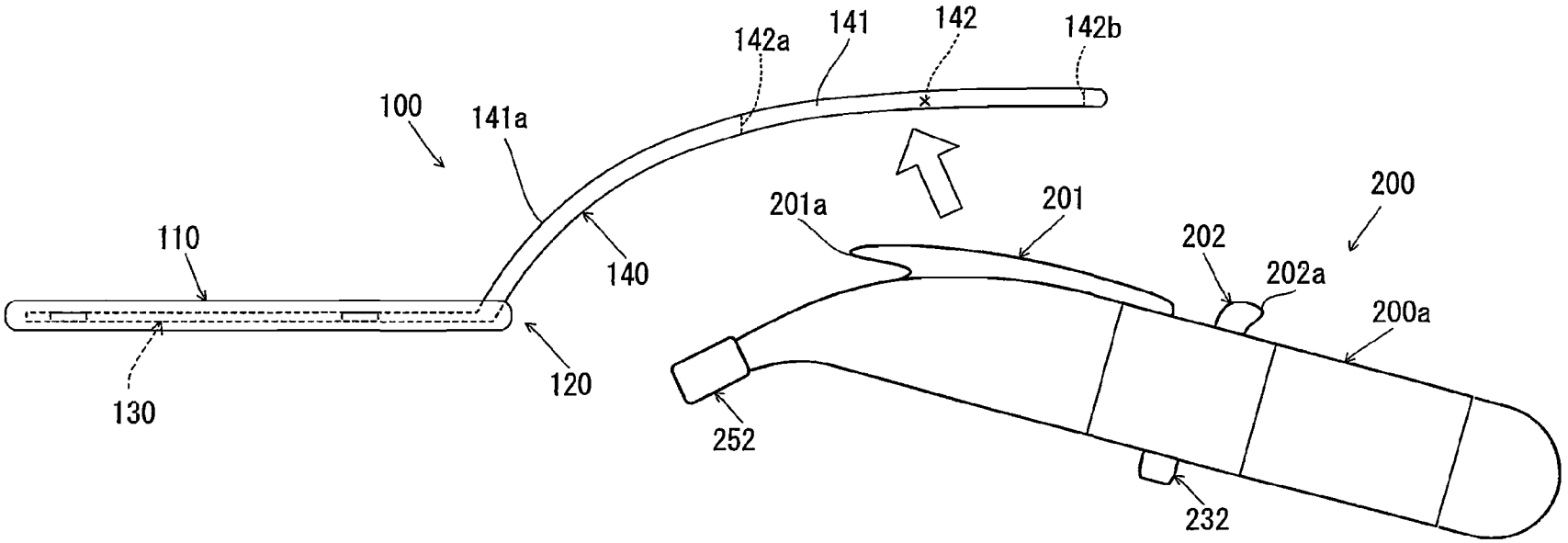
FIG. 10 shows the process of attaching the second structure 200 to the first structure 100, as viewed from the side.
Figure 11:
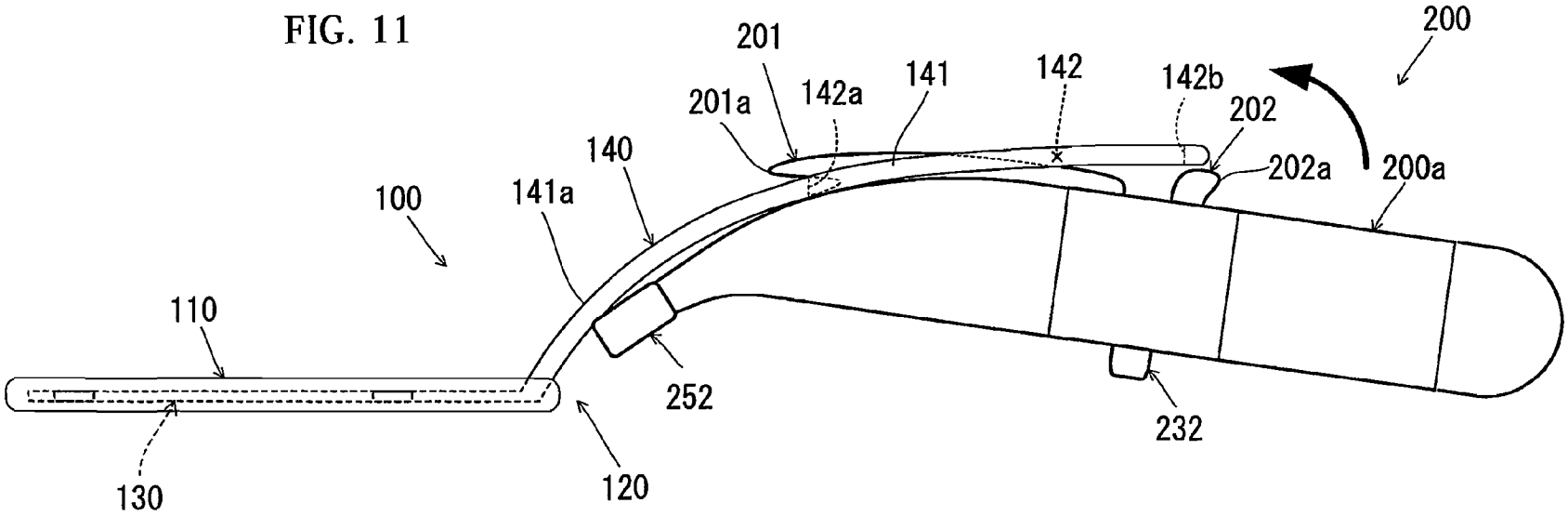
FIG. 11 shows the process of attaching the second structure 200 to the first structure 100, as viewed from the side.
Figure 12:
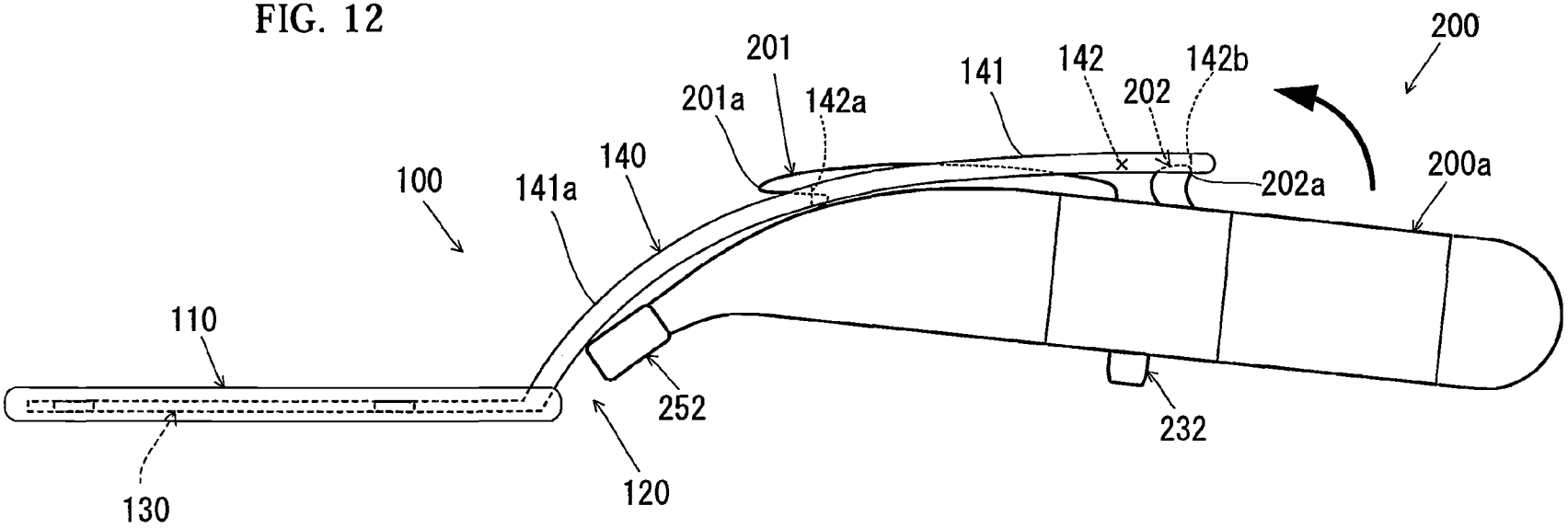
FIG. 12 shows the process of attaching the second structure 200 to the first structure 100, as viewed from the side.

The cleaning tool 10 having the above-described construction offers first use mode in which the second structure 200 is attached (connected) to the first structure 100 and second use mode in which the second structure 200 is removed (separated) from the first structure 100. Now, the first and second use modes of the cleaning tool 100 according to this embodiment is explained with reference to FIGS. 9 to 12. FIG. 9 shows the state in which the second structure 200 is removed from the first structure 100, as viewed from the side. FIGS. 10 to 12 show the process of attaching the second structure 200 to the first structure 100, as viewed from the side.

The cleaning tool 10 in this embodiment offers the first use mode which is described above with reference to FIGS. 1 to 8, and the second use mode as shown in FIG. 9. In the first use mode, in use, the second structure 200 is attached to the first structure 100, and the user holds the housing 200*a* of the second structure 200 attached to the handle body 141 and performs the cleaning operation. Particularly, the handle body 141 and the housing 200*a* of the second structure 200 attached to the handle body 141 can provide a wider region which can be held by the user. In the second use mode, the first structure 100 is independently used. The user holds the handle body 141 to which the housing 200*a* of the second structure 200 is not attached, and performs the cleaning operation. In this cleaning operation, a dry-type cleaning sheet is preferably used as the cleaning sheet 110.

The handle body 141 here is a feature that corresponds to the "grip" according to this invention. The housing 200*a* of the second structure 200 forms a grip region which is supplementary to the handle body 141, and corresponds to the "supplementary grip" according to this invention.

In order to attach the second structure 200 to the first structure 100, first, as shown in FIG. 10, the second structure 200 is placed below the first structure 100. Then, the second structure 200 is moved obliquely upward and forward such that the first locking hook 201 and the second locking hook 202 come close to the elongate hole 142 of the first structure 100 (step 1).

Then, as shown in FIG. 11, the first locking hook 201 is locked on the edge of the front end 142*a* of the elongate hole 142, with the second locking hook 202 held disengaged from the rear end 142*b* of the elongate hole 142 (step 2). For this locking movement, the first structure 100 and the second structure 200 are moved relative to each other such that the forward-projecting front end 201*a* of the first locking hook 201 can be hooked on the front end 142*a* of the elongate hole 142 from behind. By this relative movement, the first locking hook 201 is locked to the edge of the front end 142*a* of the elongate hole 142.

Subsequently, while maintaining this locked state, the second structure 200 is rotated in a direction in which the second locking hook 202 moves toward the rear end 142*b* of the elongate hole 142 (in the direction of the arrow in FIG. 11) (step 3). When the second locking hook 202 comes very close to the rear end 142*b* of the elongate hole 142, the second structure 200 is pressed from behind such that the first locking hook 201 is further pressed against the front end 142*a* of the elongate hole 142. In this state, while the rear end 202*a* of the second locking hook 202 is pushed down forward against its elastic biasing force, the second locking hook 202 is engaged on the rear end 142*b* of the elongate hole 142 (step 4). At this time, as shown in FIG. 12, the top of the second locking hook 202 is engaged on the rear end 142*b* of the elongate hole 142. Therefore, by further rotating the second structure 200 in the direction of the arrow in FIG. 12, as shown in FIG. 1, the first locking hook 201 is locked on the edge of the front end 142*a* of the elongate hole 142 and the second locking hook 202 is locked on the edge of the rear end 142*b* of the elongate hole 142 (step 5). In this manner, the second structure 200 can be attached to the first structure 100.

On the other hand, removal of the second structure 200 from the first structure 100 can be achieved by reversing the above-described procedure (step 1 to step 5) for attaching the second structure 200 to the first structure 100.

As described above, according to this embodiment, dirt and dust which are stuck to the face and difficult to wipe off with a dry-type cleaning element can be easily wiped off by supplying cleaning liquid from the injection nozzle 252 onto the face S to be cleaned and then wiping this injection region S1 with the cleaning sheet 110. Particularly, in this embodiment, the cleaning liquid is supplied directly onto the face S to be cleaned, so that the cleaning effect of the cleaning liquid itself can be maximized. Therefore, this construction is advantageous and effective in improving the cleaning effect, compared with a cleaning tool in which cleaning liquid is supplied not onto the face S to be cleaned but to the cleaning element.

Further, according to this embodiment, the injection nozzle 252 is located below the handle body 141 and rearward of the connecting part 141*a*, and further in terms of the direction of installation height, the injection nozzle 252 is located above the lower surface of the cleaning sheet 110 and in the height region in which the extension line L3 of the holder body 130 intersects with the extension line L4 of the connecting part 141*a*. With this arrangement, supply of the cleaning liquid from the injection nozzle 252 to the face S to be cleaned is not easily interfered with by the long handle body 141 and the connecting part 141*a*. Further, the user can easily check the cleaning liquid supplied area from behind, so that the operation of supplying the cleaning liquid can be smoothly and reliably performed. Further, according to this embodiment, the region of connection between the holder body 130 and the connecting part 141*a* (the handle body 141) generally coincides with the rear end of the cleaning sheet 110. With this construction, supply of the cleaning liquid from the injection nozzle 252 to the face S to be cleaned is not easily interfered with by the cleaning sheet 110. Further, when the cleaning sheet 110 is in contact with the face S to be cleaned, the injection nozzle 252 can be prevented from interfering with the face S to be cleaned. Further, the injection nozzle 252 can be located as close as possible to the face S to be cleaned, so that the cleaning liquid can be reliably and promptly supplied onto a desired region on the face S to be cleaned. Further, with the construction in which the cleaning liquid is injected from the injection nozzle 252 obliquely downward and forward toward a region located below the cleaning sheet 110, subsequently to supply of the cleaning liquid from the injection nozzle 252, in the as-is state, the cleaning sheet 110 can be moved downward and used for a wiping operation. Thus, a series of operations from a cleaning liquid supply operation to a subsequent wiping operation with the cleaning sheet 110 can be more smoothly performed. Further, with the construction in which the orientation of the injection nozzle 252 conforms to the extending direction of the connecting part 141*a*, the operation of supplying cleaning liquid to the face S to be cleaned and the operation of wiping with the cleaning sheet 110 can be facilitated.

Further, according to this embodiment, the pump mechanism 240 can be used as a means for supplying a cleaning liquid to the injection nozzle 252. Further, the pump mechanism 240 can be actuated by the user's operation of depressing the operation button 232 with the finger. By using the depressing operation with the user's finger to actuate the pump mechanism 240, the application of force to the operation button 232 can be easily achieved. Further, the action of holding the housing 200*a* of the second structure 200 is an extension of the depressing operation with the finger. Therefore, the user can hold the housing 200*a* and smoothly perform the depressing operation with the finger. Further, this construction is preferably configured such that the operation button 232 is located in the position of the ball of the forefinger of the user when the housing 200*a* is held by the user.

Further, according to this embodiment, the cleaning tool offers first use mode for use under wet conditions, in which the second structure 200 is attached to the first structure 100, and second use mode for use under dry conditions, in which the first structure 100 itself is used independently. Therefore, the user can use the two separate use modes depending on the kind of dirt on the face S to be cleaned or other similar conditions. Thus, the cleaning tool having higher usability can be provided. Further, if the cleaning tool for use in the second use mode, on which the housing 200*a* is not attached to the handle body 141, is designed and manufactured as a final product, advantageously, the cleaning tool can be converted into a product with the cleaning liquid supply mechanism for use in the first use mode.

Further, according to this embodiment, by using the two locking hooks 201, 202 formed along the length direction of the handle body 141, the state of attachment of the housing

200*a* of the second structure 200 to the handle body 141 can be stabilized. Further, in order to attach the housing 200*a* to the handle body 141, the first locking hook 201 is locked to the front end 142*a* of the elongate hole 142 so that the housing 200*a* is positioned with respect to the handle body 141, and then, while keeping this locked state, the housing 200*a* is rotated, so that the second locking hook 202 can be locked to the rear end 142*b* of the elongate hole 142. Therefore, the housing 200*a* can be attached to the handle body 141 in a simple and reliable manner. Further, the first locking hook 201 can be moved in the longitudinal direction of the elongate hole 142 with respect to the elongate hole 142 in order to be locked to the front end 142*a* of the elongate hole 142. Therefore, the housing 200*a* can be positioned in a simple and reliable manner. Further, the edge of the single elongate hole 142 can be rationally used as a locking part for both of the first and second locking hooks 201, 202.

Further, according to this embodiment, advantageously, burdensome work in a cleaning operation using a damp rag or cloth and fear of having rough dry hands can be eliminated.

Further, according to this embodiment, advantageously, the disposable cleaning sheet 110 can always be used in a sanitary condition by throwing it away after use.

(Other Embodiments)

The present invention is not limited to the above embodiment, but rather, may be added to, changed, replaced with alternatives or otherwise modified. For example, the following provisions can be made in application of this embodiment.

In the above embodiment, the mechanical pump mechanism 240 is described as pressurizing cleaning liquid and discharging the pressurized cleaning liquid to the injection nozzle 252. In this invention, however, in place of this construction, for example, the first construction using an electric pump which is actuated by the driving force of an electric motor, the second construction of aerosol type which supplies pressurized cleaning liquid to the supply nozzle by using gas pressure, the third construction which causes cleaning liquid to drop from the supply nozzle under its own weight, and the fourth construction which supplies cleaning liquid to the supply nozzle after the cleaning liquid is pressurized in a cleaning liquid supply source outside the cleaning tool, can be appropriately used. In the fourth construction, the cleaning tool does not have a pressurizing mechanism and a storing mechanism for the cleaning liquid within the housing.

Further, in the above embodiment, the operation button 232 in the form of a push button is used as an operation part for actuating the pump mechanism 240. In this invention, however, a sliding operation part can also be used. Further, the operation button 232 may be disposed on other than the underside of the pump housing 230, such as on the top or side of the pump housing 230.

Further, in the above embodiment, an adjusting mechanism for adjusting the conditions for supplying the cleaning liquid from the injection nozzle 252 to the face S to be cleaned may be additionally provided. Specifically, the adjusting mechanism may be constructed such that the sectional area of the throttle hole within the supply nozzle can be adjusted by using a switch or other similar switching device, so that the conditions for supplying the cleaning liquid, such as the amount, the range (angle), the distance and the area of supply of the cleaning liquid can be adjusted. With provision of such a construction, the conditions for supplying the cleaning liquid can be adjusted depending on the degree of dirt of the face S to be cleaned. Thus, the cleaning tool having higher usability can be provided.

Further, in the above embodiment, the storage tank 212 is described as being fixedly provided for exclusive use within the housing 200*a* of the second structure 200. In this invention, however, a cartridge-type tank may also be used which can be replaced with new one when it runs out of cleaning liquid. As for the specific construction of this cartridge-type tank, for example, it may typically include a storage container molded of hard resin, and also include a pouch-type bottle formed of pouch sheet material and a storage container formed of transparent or semitransparent resin material through which the remaining amount of cleaning liquid can be visually checked.

Further, in the above embodiment, the housing 200*a* attached to the handle body 141 is described as forming the grip to be held by the user in the first use mode in which the second structure 200 is attached to the first structure 100. In this invention, however, it may also be designed such that the housing 200*a* is attached to a place other than the handle body 141 in the first use mode. In this case, the housing 200*a* may still form the grip to be held by the user, or the handle body 141 may form the grip to be held by the user.

Further, in the above embodiment, the first and second locking hooks 201, 202 are described as being locked to a locking part in the form of the single elongate hole 142. In this invention, however, the numbers of locking parts and locking hooks, the locking manner and the locking structure can be appropriately changed. In this invention, two holes may be formed in place of the elongate hole 142, one hole for engagement with the first locking hook 201 and the other for engagement with the second locking hook 202. Further, as for the locking manner, manners of locking, for example, by hooking one on the other or fitting one in or on the other can be appropriately used. Further, as for the structure of the locking part, a hole, a groove, a slit, etc. can be appropriately used.

Further, in the above embodiment, the cleaning sheet holder 120 is molded in one piece including the holder body 130 and the handle 140 which cannot move with respect to each other at the connection therebetween. In this invention, however, a movable structure may also be used in which relative movement at the connection is temporarily enabled. Specifically, a hinge mechanism and a locking mechanism are provided at the connection between the holder body 130 and the handle 140. The angle between the holder body 130 and the handle 140 can be adjusted via the hinge mechanism before and after use of the cleaning tool 10, and it can be locked or retained at a predetermined angle by the locking mechanism during use of the cleaning tool 10.

DESCRIPTION OF NUMERALS

10 cleaning tool
100 first structure
110 cleaning sheet
111 cleaning sheet body
112 joining sheet
113 central fusion-bonding line
114 side mounting line
115 holding space
115*a* rear open end
115*b* front open end
116 narrowing fusion-bonding line
117 narrow part
118 wide part
120 cleaning sheet holder
130 holder body
131 base
131*a* engagement plate

131*b* recess
132 holding plate
133 projection
134 retaining plate
140 handle
141 handle body
141*a* connection
142 elongate hole
142*a* front end
142*b* rear end
143 first engaging plate
144 second engaging plate
145 engagement space
200 second structure
200*a* housing
201 first locking hook
201*a* front end
202 second locking hook
202*a* rear end
210 tank housing
212 tank
214 supply tube
216 tank cap
217 air hole
220 valve mechanism
221 communication hole
222 valve disc
230 pump housing
232 operation button
240 pump mechanism
241 inlet port
242 flow passage
243 pressurizing member
244 outlet port
245 first ball
246 second ball
247, 248, 249 coil spring
250 discharge housing
251 guide tube
252 injection nozzle
253 throttle hole
S face to be cleaned
S1 injection region

The invention claimed is:

1. The combination of a cleaning tool and a cleaning liquid supply assembly, wherein:

the cleaning tool comprises:

a holding part for holding a sheet-type cleaning element;

a grip for holding the cleaning tool, said grip having an upper surface and a bottom surface; and a connecting part connecting the holding part to the grip; and the cleaning liquid supply assembly comprises:

a tank housing, a pump housing and a discharge housing;

a supply nozzle for supplying cleaning liquid toward the face to be cleaned is disposed on the discharge housing;

an operation button disposed on an underside the discharge housing which when depressed toward the grip causes cleaning liquid to be dispensed from the supply nozzle; and first and second locking parts that are spaced apart from one another along the discharge housing and pump housing, wherein the first locking part comprises a first locking hook and the second locking part comprises a second locking hook, with the operation button being positioned between the first and second locking hooks, the grip includes an elongate hole that extends through said upper and bottom surfaces of said grip and the first and second locking parts extend through said elongate hole when the grip is coupled to the cleaning supply assembly so that the first and second locking hooks extend through and engage the upper surface of the grip at opposite end portions of the elongated hole, with a contacting area between the first locking hook and the upper surface of the grip being longer than a contacting area between the second locking hook and the upper surface of the grip, the cleaning liquid supply assembly and the grip are attached together and the discharge housing and the pump housing, but not the tank housing overlap the grip, and wherein in a first mode a user grips the grip of the cleaning tool to clean a surface and in a second mode a user couples the grip of the cleaning tool to the first and second locking parts of the cleaning liquid supply assembly and grips the elongate housing of the cleaning liquid supply assembly to clean a surface that is sprayed with cleaning liquid from the cleaning liquid supply assembly.

2. The combination as defined in claim 1, wherein the supply nozzle of the cleaning liquid supply part is located below the grip and rearward of the connecting part.

3. The combination as defined in claim 2, wherein a region of connection between the holding part and the connecting part generally coincides with a rear end of the cleaning element.

4. The combination as defined in claim 2, wherein, further in terms of a direction of installation height, the supply nozzle is located above a sheet lower surface of the cleaning element and in a height region in which an extension line of the holding part intersects with an extension line of the connecting part.

5. The combination as defined in claim 1, wherein the cleaning liquid supply part supplies the cleaning liquid from the supply nozzle obliquely downward and forward toward a region located below the cleaning element.

6. The combination as defined in claim 5, wherein the orientation of the supply nozzle of the cleaning liquid supply part conforms to an extending direction of the connecting part.

7. The combination as defined in claim 1, wherein the cleaning liquid supply assembly includes a pump mechanism that pressurizes cleaning liquid by user's manual operation of operation button and then discharges the pressurized cleaning liquid to the supply nozzle.

8. The combination as defined in claim 7, wherein the operation button is disposed on the underside of the grip, and the pump mechanism is actuated by user's operation of depressing the operation button with a finger while holding the grip with the hand.

9. The combination as defined in claim 8, wherein the operation button is configured to be touched by the user's finger, and a finger entry preventing region for preventing entry of the user's finger is provided between the operation button and the grip.

10. The combination as defined in claim 7, wherein the pump mechanism discharges a predetermined amount of cleaning liquid to the supply nozzle in one manual operation of the operation button.

11. The combination as defined in claim 1, wherein the cleaning liquid supply assembly includes an adjusting mechanism for adjusting the conditions for supplying the cleaning liquid from the supply nozzle to the face to be cleaned.

12. The combination as defined in claim 1, wherein the tank housing forms an outer shell of the cleaning liquid supply assembly, and a storage tank that stores cleaning liquid, the tank housing and the storage tank being integrally configured as an assembly.

13. The combination as defined in claim 12, wherein the cleaning liquid supply assembly is configured such that an outer peripheral surface of the tank housing is contiguous to an outer peripheral surface of the storage tank.

14. The combination as defined in claim 12, wherein the cleaning liquid supply assembly is configured such that the sectional shape of the tank housing substantially conforms to the sectional shape of the storage tank.

15. The combination as defined in claim 12, wherein, in the cleaning liquid supply assembly, an outer surface of the tank housing is similar in color to an outer surface of the storage tank.

16. The combination as defined in claim 1, wherein the connecting part is curved, and the elongate housing is curved to conform to the curve of the connecting part and such that an end of the elongate housing on the side of the supply nozzle is located at a lowest level.

17. The combination as defined in claim 1, wherein the holding part, the grip and the connecting part are resin molded.

18. The combination as defined in claim 1, wherein the holding part, the grip and the connecting part are integrally molded.

* * * * *